US005572299A

United States Patent [19]

Kato et al.

[11] Patent Number: 5,572,299

[45] Date of Patent: Nov. 5, 1996

[54] DEVELOPING DEVICE USING TWO-COMPONENT DEVELOPER

[75] Inventors: Makoto Kato; Sachio Sasaki; Shin Araki; Kunihiko Sato; Naoyuki Fujimoto, all of Kawasaki, Japan

[73] Assignee: Fujitsu Limited, Kawasaki, Japan

[21] Appl. No.: 84,277

[22] PCT Filed: Nov. 9, 1992

[86] PCT No.: PCT/JP92/01452

§ 371 Date: Jul. 8, 1993

§ 102(e) Date: Jul. 8, 1993

[87] PCT Pub. No.: WO93/09475

PCT Pub. Date: May 13, 1993

[30] Foreign Application Priority Data

Nov. 8, 1991 [JP] Japan ..... 3-292735

[51] Int. Cl.[6] ..... G03G 15/06

[52] U.S. Cl. ..... 399/256; 399/259

[58] Field of Search ..... 355/245, 251, 355/255, 259, 260, 246; 118/653, 657, 658

[56] References Cited

U.S. PATENT DOCUMENTS

| | | | |
|---|---|---|---|
| 3,764,208 | 10/1973 | Takahashi et al. . | |
| 4,064,834 | 12/1977 | Sund | 355/246 X |
| 4,576,466 | 3/1986 | Fukuchi et al. | 355/253 |
| 4,583,842 | 4/1986 | Shimono et al. | 355/266 |
| 4,660,505 | 4/1987 | Goto et al. | 118/658 X |
| 4,800,412 | 1/1989 | Ueda | 355/251 |
| 4,804,995 | 2/1989 | Osawa et al. | 118/657 X |
| 4,864,349 | 9/1989 | Ito | 355/253 |
| 4,913,087 | 4/1990 | Saita et al. | 118/653 |
| 5,003,917 | 4/1991 | Toyoshi et al. | 118/653 |
| 5,017,967 | 5/1991 | Koga | 355/253 X |
| 5,049,938 | 9/1991 | Ueda | 355/246 |
| 5,054,419 | 10/1991 | Itaya et al. | 118/657 |
| 5,075,728 | 12/1991 | Kobayashi et al. | 355/260 |
| 5,095,339 | 3/1992 | Terashima | 355/253 X |
| 5,122,834 | 6/1992 | Okamoto et al. | 355/246 X |
| 5,355,199 | 10/1994 | Bray | 355/245 |
| 5,430,528 | 7/1995 | Kumasaka et al. | 355/251 |
| 5,436,703 | 7/1995 | DeYoung et al. | 355/245 |
| 5,510,882 | 4/1996 | Kikuta et al. | 355/245 |
| 5,510,883 | 4/1996 | Kimura et al. | 355/245 |

FOREIGN PATENT DOCUMENTS

| | | |
|---|---|---|
| 0401046 | 12/1990 | European Pat. Off. . |
| 2904331 | 6/1980 | Germany . |
| 58-65460 | 4/1983 | Japan . |
| 60-181767 | 9/1985 | Japan . |
| 9109350 | 6/1991 | WIPO . |

*Primary Examiner*—Arthur T. Grimley
*Assistant Examiner*—Shuk Yin Lee
*Attorney, Agent, or Firm*—Staas & Halsey

[57] ABSTRACT

A developing device has a vessel for holding a two-component developer composed of a toner component and a magnetic component. A magnetic roller is rotatably provided within the vessel to bring the developer to a developing zone for a development of an electrostatic latent image. An agitator also is provided within the vessel for agitating and circulating the developer to cause a triboelectrifiction between the toner component and the magnetic component and a uniform distribution of the toner component in the magnetic component. The agitator is arranged to present a uniform density mass of the developer to the magnetic roller for ensuring an even development of the latent image.

30 Claims, 30 Drawing Sheets

DEVELOPING DEVICE USING TWO-COMPONENT DEVELOPER

TECHNICAL BACKGROUND

The present invention relates to a developing device used in an image formation apparatus such as a copying machine, a laser printer, a facsimile or the like, wherein an electrostatic latent image is electrostatically developed with a two-component developer.

PRIOR ART

Generally, in an image formation apparatus such as an electrophotographic recording apparatus, the following processes are typically carried out:

a) a uniform distribution of electrical charges is produced on a surface of an electrostatic latent image carrying body;

b) an electrostatic latent image is formed on a charged area of the body surface by an optical writing means such as a laser beam scanner, an LED (light emitting diode) array, a liquid crystal shutter array or the like;

c) the latent image is developed as a visible image with a developer or toner, which is electrically charged to be electrostatically adhered to the latent image zone;

d) the developed and charged toner image is electrostatically transferred from the body to a recording medium such as a cut sheet paper; and e) the transferred toner image is fixed and recorded on the cut sheet paper by a toner image fixing means such as a heat roller.

Typically, the electrostatic latent image carrying body may be an electrophotographic photoreceptor, usually formed as a drum, called a photosensitive drum, having a cylindrical conductive substrate formed of a metal such as aluminum, and a photoconductive insulating film bonded to a cylindrical surface thereof and formed of an organic photoconductor (OPC), a selenium photoconductor or the like.

As one type of developer, a two-component developer is well known, which is composed of a toner component (colored fine synthetic resin particles) and a magnetic component (fine magnetic carriers). Usually, a developing device using this type of developer includes a vessel for holding the two-component developer, wherein the developer is agitated by an agitator provided therein. This agitation causes the toner particles and the magnetic carriers to be subjected to triboelectrification, whereby the toner particles are electrostatically adhered to each of the magnetic carriers. The developing device also includes a magnetic roller provided in the vessel as a developing roller in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to a nip zone or developing zone between the magnetic roller and the drum for development of an electrostatic latent image formed thereon. In the developing process, a developing bias voltage is applied to the magnetic roller so that the toner particles carried to the developing zone are electrostatically attracted only to the latent image, whereby the toner development of the latent image is carried out. The magnetic brush, from which the toner component is consumed for the development of the latent image, is removed from the magnetic roller and is then returned to the developer held in the vessel. For this reason, in the developer held in the vessel, the toner component cannot be uniformly distributed in the magnetic component. Of course, the non-uniform distribution of the toner component in the magnetic component causes an uneven development of a latent image.

One type of developing device using the two-component developer, a developer circulation type, which is known, is provided with an agitator including a pair of screw members provided in the developer vessel and disposed in parallel with each other, and a partition member disposed between the screw members. The screw members are arranged and rotated in such a manner that a part of the developer held in the vessel is circulated between the screw members for the purpose of a uniform distribution of the toner component in the magnetic component. Nevertheless, the conventional developer-circulation type developing device is not satisfactory because an even development of a latent image cannot be sufficiently ensured, and that the developer can be prematurely deteriorated, as discussed in detail hereinafter.

DISCLOSURE OF THE INVENTION

Therefore, an object of the present invention is to provide an improved developer-circulation type developing device using a two-component developer, which is arranged so that an even development of a latent image can be sufficiently ensured.

Another object of the present invention is to provide a developer-circulation type developing device as mentioned above, wherein a premature deterioration of a developer can be prevented.

In accordance with one aspect of the present invention, there is provided a developing device using a two-component developer composed of a toner component and a magnetic component, which comprises: a vessel means for holding the developer; a magnetic roller means rotatably provided within the vessel means to bring the developer to a developing zone for a development of an electrostatic latent image; and an agitator means for agitating and circulating the developer to cause a triboelectrification between the toner component and the magnetic component and a uniform distribution of the toner component in the magnetic component, and in the present invention, the agitator means includes a presentation means for presenting a uniform density mass of the developer to the magnetic roller means.

In the present invention, preferably, the presentation means includes a first screw means disposed in parallel with the magnetic roller means and rotated in such a manner that a developer entrapped by the screw mean is upwardly moved from a bottom side of the vessel means toward a top side thereof at a side of the first screw means adjacent to the magnetic roller means. Also, preferably, the magnetic roller means is rotated in the same direction as the first screw means so that a developer brought by the magnetic roller, passed through the developing zone, and removed from the magnetic roller is entrapped by the first screw means means.

According to the present invention, the presentation means may further include a second screw member disposed in parallel with the first screw member at an opposite side thereof apart from the magnetic roller means, and the first and second screw means are arranged to define a developer circulating passage, and are cooperatively rotated in such a manner that a propellant force derived from the first and second screw means is prevented from being directed to a corner involved in the developer circulating passage.

Preferably, the developing device further comprises a blade means engaged with the magnetic roller means for removing a developer brought by the magnetic roller and passed through the developing zone, from the magnetic roller, the blade means being at least extended to a location adjacent to a side of the agitator means next to the magnetic roller means. The blade means may have an acute edge formed thereat, and is arranged such that the acute edge thereof is close to the magnetic roller means at a transition at which a radial magnetic flux density is substantially zero. Also, the blade means may have a film edge element attached thereto, and is arranged such that the film edge element is in contact with the magnetic roller means at a transition at which a radial magnetic flux density is substantially zero.

DESCRIPTION OF THE DRAWINGS

Other objects and advantages of the present invention will be better understood from the following description, with reference to the accompanying drawings, in which:

FIG. 4(*b*) is an illustration for explaining technical demerits of a related art;

FIG. 4(*c*) is a graph showing a variation of a density of a toner image obtained from each of the cases of FIGS. 4(*a*) and 4(*b*);

FIG. 5(*b*) is a cross-sectional view taken along line b—b of FIG. 5(*a*);

FIG. 6(*b*) is a cross-sectional view taken along line b—b of FIG. 6(*a*);

FIG. 6(*c*) is a graph proving that the arrangement of FIG. 5(*a*) is superior to that of FIG. 6(*a*);

FIG. 7(*b*) is a cross-sectional view taken along line b—b of FIG. 7(*a*);

FIG. 8(*b*) is a cross-sectional view taken along line b—b of FIG. 8(*a*);

FIG. 11(*b*) is an end view showing a propeller element of the multi-propeller member shown in FIG. 11(*a*);

FIG. 11(*c*) is a plan view showing the propeller element of the multi-propeller member shown in FIG. 11(*a*);

FIG. 12(*b*) is an end view showing a propeller element of the multi-propeller member shown in FIG. 12(*a*);

FIG. 12(*c*) is a plan view showing the propeller element of the multi-propeller member shown in FIG. 12(*b*);

FIG. 13(*b*) is a perspective view showing an endless belt used in the developing device shown in FIG. 13(*a*);

FIG. 13(*c*) is an elevation view of a drive system for the endless belt shown in FIG. 13(*b*);

FIG. 15(*b*) is a cross-sectional view of a developing device according to the present invention, including another type of scraper blade member for removing a developer from a magnetic roller;

FIG. 15(*c*) is a cross-sectional view of a developing device according to the present invention, including yet another type of scraper blade member for removing a developer from a magnetic roller;

FIG. 15(*d*) is a graph showing a variation of a density of a toner image obtained from each of the cases of FIGS. 15(*a*) and 15(*b*);

FIG. 20(*b*) is a cross-sectional view taken along line b—b of FIG. 20(*a*);

FIG. 21(*b*) is a cross-sectional view taken along line b—b of FIG. 21(*a*);

FIG. 22(*b*) is a cross-sectional view taken along line b—b of FIG. 22(*a*);

BEST MODE OF CARRYING OUT THE INVENTION

Figure 1:
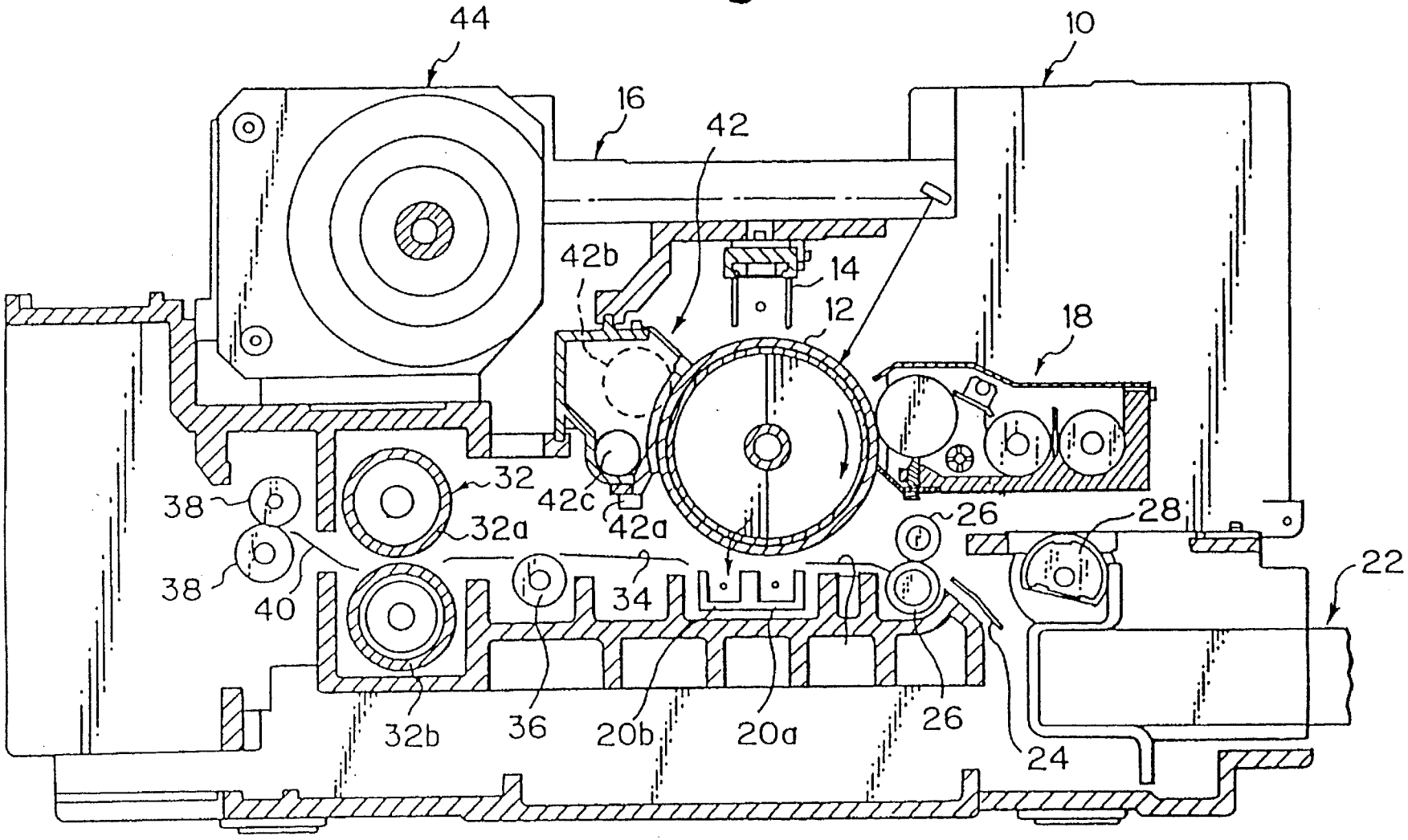
FIG. 1 is a schematic view showing an electrophotographic laser printer in which a developing device according to the present invention is used.

FIG. 1 schematically shows a laser printer as an example of an electrophotographic laser printer, in which the present invention is embodied. This printer comprises a printer housing 10, and a rotary photosensitive drum 12 formed as a latent image carrying body and housed in the printer housing 10. During an operation of the printer, the drum 12 is rotated in a direction indicated by an arrow in FIG. 1.

The printer also comprises an electric discharger 14 such as a corona discharger for producing a charged area on the photosensitive drum 12, and a laser beam scanner 16 is provided to write an electric latent image on the charged area of the drum 12. The laser beam scanner includes a laser source such as a semiconductor laser diode for emitting a laser light, an optical system for focusing the laser light into a laser beam LB, and an optical scanning system such as a polygon mirror for deflecting the laser beam LB along a direction of a central axis of the drum 12 so that the charged area of the drum 12 is scanned by the deflecting laser beam LB. During the scanning, the laser beam LB is switched on and off on the basis of binary image data obtained from, for example, a word processor, personal computer or the like, so that an electrostatic latent image is written as a dot image on the charged area of the drum 12. In particular, when a zone of the charged area is irradiated by the laser beam LB, the charges are released from the irradiated zone so that the latent image is formed as a potential difference between the irradiated zone and the remaining zone.

The printer further comprises a developing device 18 for electrostatically developing the latent image with a two-component developer composed of a toner component (colored fine resin particles) and a magnetic component (magnetic fine carriers). In the developing device 18, the developer is agitated so that the toner particles are electrically charged with a given polarity by a triboelectrification with the magnetic carriers, and the development of the latent image is carried out by an electrostatic attraction of the charged toner particles to the latent image, as mentioned in the "Description of the Related Prior Art". Note, the developing device 18 is constructed as a developer-circulation type according to the invention, and an arrangement thereof is explained in detail hereinafter.

Furthermore, the printer comprises a transfer charger assembly 20 for electrostatically transferring the developed toner image to a recording medium such as a cut sheet paper, which is introduced into a clearance between the photosensitive drum 12 and the transfer charger assembly 20. The transfer charger assembly 20 includes a transfer charger 20*a*, and an AC charge eliminator 20*b* disposed adjacent to the transfer charger 20*a*. The transfer charger, which may be a corona discharger, is subjected to an application of a DC electric energy to give the paper an electric charge having a polarity opposite to that of the electric charge of the developed toner image, whereby the toner image is electrostatically transferred from the drum 12 to the paper. The AC charge eliminator 20*b*, which also may be a corona discharger, is subjected to an application of an AC electric energy to partially eliminate the electric charge of the paper to which the toner image is transferred, whereby an electrostatic attraction acting between the paper and the drum can be weakened for an effective separation of the paper from the drum 12.

The printer is provided with a paper cassette 22 in which a stack of paper is received, and a paper guide 24 extended from the paper cassette 22 toward a pair of register roller 26, 26. During the printing operation, papers to be printed are fed one by one from the paper cassette 22 along the paper guide 24 by driving a paper feeding roller 28 incorporated in the paper cassette 22. The fed paper is stopped once at the register rollers 26, 26, and is then introduced, at a given timing, into the clearance between the drum 12 and the assembly 20 through a paper guide 30 extended between the register rollers 26, 26 and the assembly 20, so that the developed toner image can be transferred to the paper in place.

The paper discharged from the clearance between the drum 12 and the assembly 20, i.e., the paper carrying the transferred toner image, is then moved toward a toner image fixing device 32 along a paper guide 34 extended between the assembly 20 and the fixing device 32 and having a paper guide roller 36 incorporated therein, and is passed through a nip between a heat roller 32*a* and a backup roller 32*b* of the fixing device 32, whereby the transferred toner image is thermally fused and fixed on the paper. The paper having the fixed toner image is fed to a pair of paper discharging rollers 38, 38 along a paper guide 40 extended between the fixing device 32 and the paper discharging rollers 38, 38, and is then discharged from the printer through the rollers 38, 38.

The printer is also provided with a toner cleaner 42 having a charge eliminating lamp 42*a* attached thereon, and a fur brush 42*b* provided therein. The lamp 42*a* illuminates a surface of the drum 12 for eliminating the charges therefrom, and the fur brush 42*b* cleans the drum surface to remove residual toner particles not transferred to the paper in the transferring process. The toner cleaner 42 also has an outlet port 42*c* formed therein to discharge the removed toner particles therethrough, and the discharged toner particles are returned to the developing device 18 to be recycled. Note, in FIG. 1, reference numeral 44 indicates an main electric motor by which the drum 12, the developing device 18, the paper feeding roller 28, the register rollers 26, 26, the fixing device 32, etc., are driven.

Figure 2:
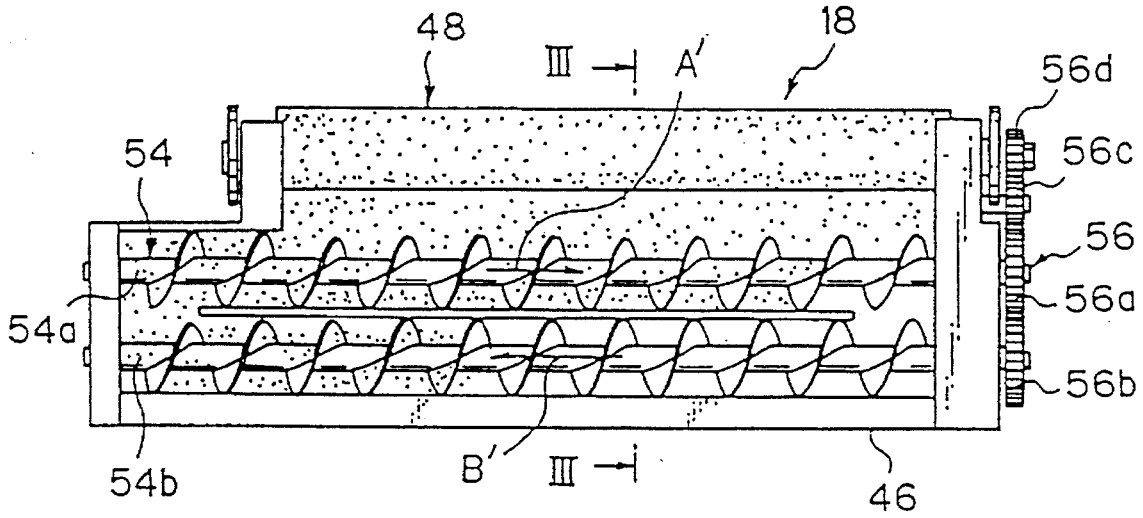
FIG. 2 is a plan view showing the developing device of the electrophotographic laser printer shown in FIG. 1.
Figure 3:
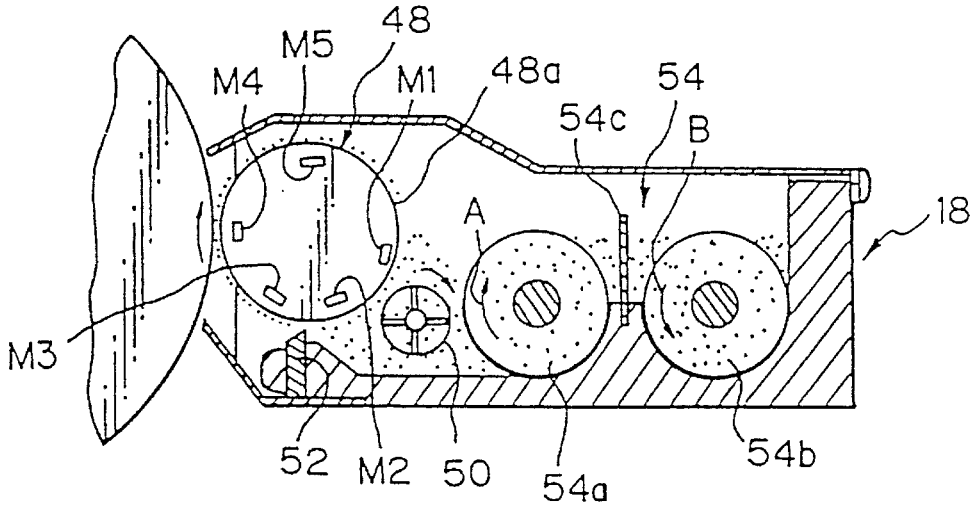
FIG. 3 is a cross-sectional view taken along line III—III of FIG. 2.

FIGS. 2 and 3 show an embodiment of the developer-circulation type developing device 18 constructed according to the present invention. The developing device includes a vessel 46 for holding the two-component developer, an existence of which is illustrated by a plurality of fine dots. Although the vessel 46 is covered by a cover plate member 46*a*, as shown in FIG. 3, this cover plate member 46*a* is omitted from FIG. 2 to illustrate an interior of the vessel 46. The developing device 18 also includes a developing roller or magnetic roller 48 rotatably provided in the vessel 46 in such a manner that a portion of the magnetic roller 48 is exposed therefrom and faces the photosensitive drum 12. The magnetic roller 48 has a rotatable sleeve 48*a* formed of a nonmagnetic material such as aluminum, and five bar-like permanent magnet elements elements M1, M2, M3, M4, and M5 immovably provided within the sleeve 48*a* and coextended therewith. During an operation of the developing device 18, only the sleeve 48*a* is rotated in a direction indicated by an arrow in FIG. 3 in such a manner that a rotating surface of the sleeve 48*a* ascends to a developing zone defined as a nip zone between the drum 12 and the magnetic roller 48. The magnet elements M1, M2, M3 and M4 are disposed at suitable intervals along a lower semicircular arc which is substantially defined by a horizontal plane including a rotational axis of the sleeve 48*a* of the magnetic roller 48, whereas the magnetic element M5 is disposed substantially at a top of the upper semicircular arc defined by said horizontal plane.

The magnet elements M1, M3, and M5 are identically oriented with respect to the sleeve 48*a*, and also the elements M2 and M4 are identically oriented with respect to the sleeve 48*a*, but the orientation of the elements M1, M3, and M5 is opposite to that of the elements M2 and M4. Namely, for example, when each of the elements M1, M3, and M5 is oriented so that the S polarity thereof is directed to an inner surface of the sleeve 48*a*, each of the elements M2 and M4 is reversely oriented so that the N polarity thereof is directed to the inner surface of the sleeve 48*a*. Thus, a magnetic field is produced above an outer surface section of the sleeve 48*a* defined by each of four sets of the two adjacent magnet elements M1 and M2; M2 and M3; M3 and M4; and M4 and M5, but no magnetic field is produced above an Outer surface section of the sleeve 48*a* defined by the remaining set of the two adjacent magnet elements M5 and M1 because these magnetic elements are identically oriented with the respect to the sleeve 48*a*.

With the arrangement of the magnet elements M1 to M5, during the rotation of the sleeve 48*a* in the direction indicated by the arrow in FIG. 2, a part of the developer held in the vessel 48*a* can be magnetically adhered to and entrained by the sleeve 48*a* due to the production of the magnetic fields by the four sets of the two adjacent magnet elements M1 and M2; M2 and M3; M3 and M4; and M4 and M5, so that the entrained developer is brought toward the developing zone for the development of the latent image. When the developer passed through the developing zone is moved into the non-magnetic field zone produced by the two adjacent magnet elements M5 and M1, the entrained developer is released from the magnetic adhesive force to the sleeve 48*a*, and is thus removed therefrom due to gravity. The removed developer is returned to the developer held in the vessel 46 so that a fresh part of the developer can be always entrained by the sleeve 48*a*, whereby a proper development of the latent image can be ensured. Note, the developer passed through the developing zone has a smaller content of the toner component than that of the developer held in the vessel 46, because the development of the latent image is carried out by the toner component of the developer.

The developing device 18 may be provided with a paddle roller 50 disposed beside the magnetic roller 48 and rotated in a direction indicated in FIG. 3 for feeding a fresh part of the developer to the magnetic roller 48. Also, the developing device 18 may be provided with a doctor blade 52 for regulating an amount of the developer entrained by the magnetic roller 48. In particular, the developer is entrained by the magnetic roller 48 so as to form a magnetic brush having a plurality of fine spike-like elements, and a length of the fine spike-like elements should be uniformly regulated before an even development of the latent image can be ensured. Note, each of the spike-like elements is formed of a plurality of magnetic carriers magnetically connected to each other.

The developing device 18 further includes a screw type agitator 54 provided in the vessel 46 to agitate the developer held therein, to cause the triboelectrification between the toner component and the magnetic component. The agitator 54 has at least two screw members 54*a* and 54*b* disposed in parallel with each other and rotatably supported at the ends thereof by end walls of the vessel 46, and a partition member 54*c* provided between the two screw members 54*a* and 54*b* and extended therealong. In this embodiment, each of the screw members 54*a* and 54*b* is provided with a right-hand flight as shown in FIG. 2. Accordingly, when the screw member 54*a* is rotated as indicated by an arrow A (FIG. 3), a developer entrapped thereby is propelled in a direction indicated by an arrow A' (FIG. 2), and, when the screw member 54*b* is rotated as indicated by an arrow B (FIG. 3), a developer entrapped thereby is propelled in the reverse direction indicated by an arrow B' (FIG. 2). Namely, each of the screw members 54*a* and 54*b* defines a passage for moving a part of the developer held in the vessel 46. As apparent from FIG. 2, the screw members 54*a* and 54*b* have the same length, but the partition member 54*c* has a length shorter than that of the screw members 54*a* and 54*b*, so that the developer passages defined by the screw members 54*a* and 54*b* are in communication with each other at the ends of the partition member 54*c*, whereby a part of the developer propelled by one of the screw members 54*a*, 54*b* is entrapped by the other screw member 54*a*, 54*b*. Thus, during an operation of the developing device 18, a part of the developer held in the vessel 46 is always circulated along the developer passages defined by the screw members 54*a* and 54*b*, whereby not only can the toner component be sufficiently charged by a triboelectrification with the magnetic component, but also a uniform distribution of the toner component in the magnetic component can be ensured. Note, the screw member 54*a*, 54*b* may be integrally formed of a suitable resin material such as ANS resin, and have, for example, a shaft diameter of 8 mm, a screw flight diameter of 25 mm, and a screw flight thickness of 1 mm.

As shown in FIG. 2, a gear train 56 is provided on one end wall of the vessel 46, and includes a gear 56*a* mounted on an end of the screw member 54*a*, a gear 56*b* mounted on a corresponding end of the screw member 54*b* and engaged with the gear 56*a*, an idler gear 54*c* engaged with the gear 56*a*, and a gear 56*d* engaged with the idler gear 54*c* to rotate the sleeve 48*a* of the magnetic roller 48. With this arrangement of the gear train 56, when the gear 56*d* is subjected to a rotational drive force from the main motor 44 (FIG. 1) through a drive mechanism (not shown) to rotate the sleeve 48*a* in the direction indicated by the arrow in FIG. 3, the screw members 54*a* and 54*b* can be rotated in the directions indicated by the arrows A and B, respectively. Note, of course, the gear train 56 may include a gear (not shown) for rotating the paddle roller 50 in the direction indicated by the arrow in FIG. 3.

Figure 4A:
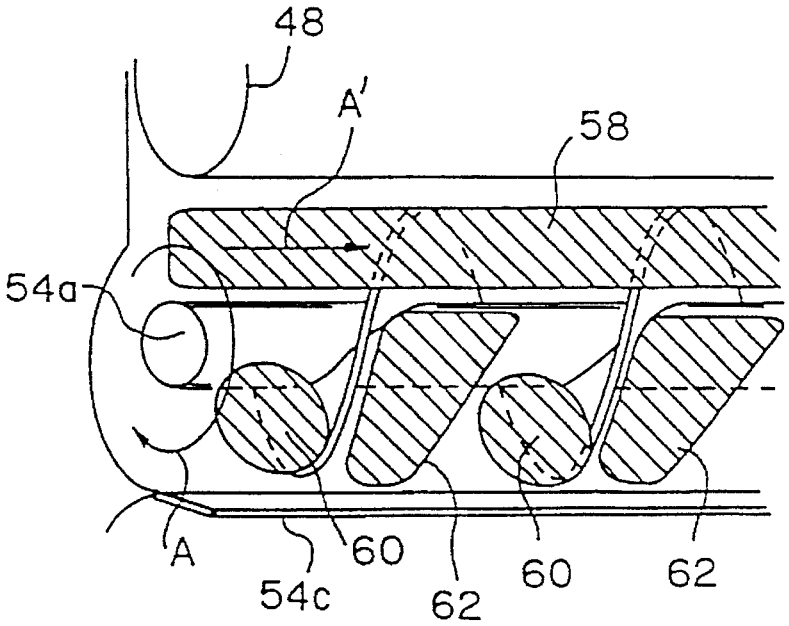
FIG. 4(*a*) is an illustration for explaining technical merits of the present invention.
Figure 4B:
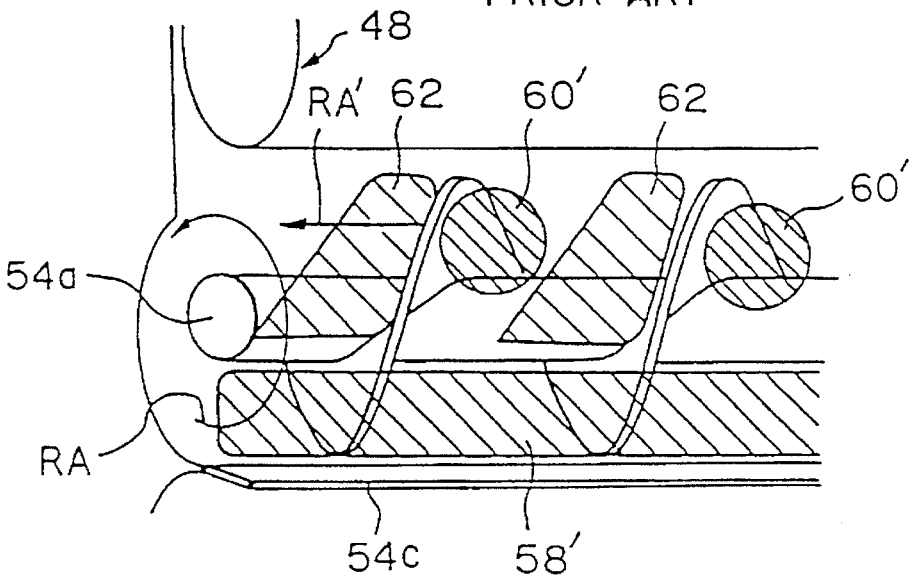
Fig. 4(b) PRIOR ART
Figure 4C:
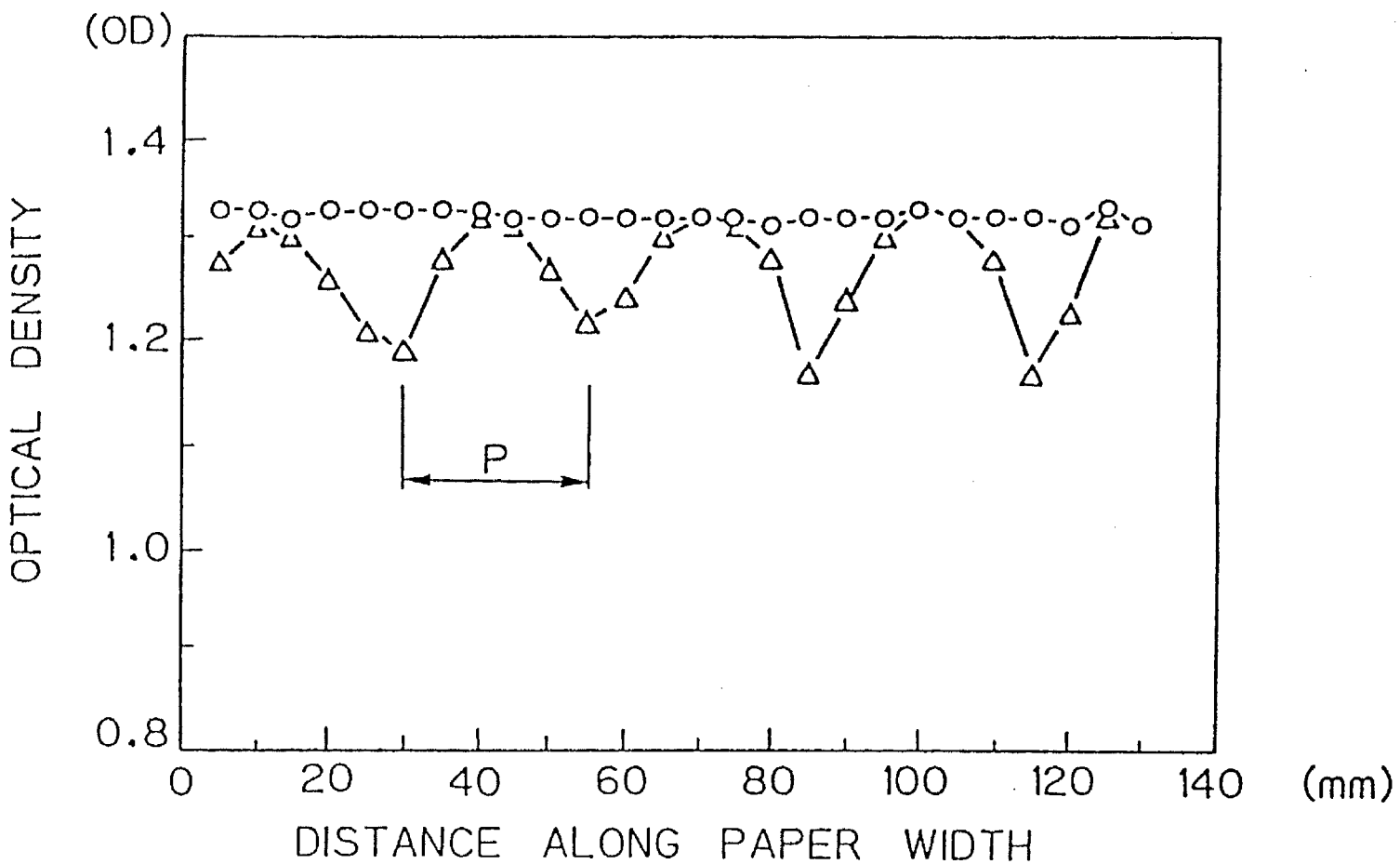

According to an aspect of the present invention, the developing device 18 is characterized in that the screw member 54*a* disposed adjacent to the magnetic roller 46 is rotated in the direction indicated by the arrow A, so that the screw flight of the screw member 54*a* is upwardly moved from a bottom side of the vessel 46 toward a top side thereof at a side of the screw member 54*a* adjacent to the magnetic roller 48. Accordingly, the developer entrapped by the screw member 54*a* also is upwardly moved from the bottom side of the vessel 46 to the top side thereof at the side of the screw member 54*a* adjacent to the magnetic roller 48. On the other hand, the entangled developer is downwardly moved from the top side of the vessel 46 toward the bottom side thereof at the opposite side of the screw member 54*a* adjacent to the partition member 54*c*. As a result, the developer propelled by the screw member 54*a* in the direction indicated by the arrow A' has a uniform density at the side of the screw member 54*a* adjacent to the magnetic roller 48, and a nonuniform density at the opposite side of the screw member 54*a* adjacent to the partition member 54*c*, as illustrated in FIG. 4(*a*). Namely, in this drawing, a part of the propelled developer having the uniform density is indicated as a hatching zone 58, and a part of the propelled developer having the non-uniform density is indicated as two kinds of hatching zones 60 and 62. Note, a density of developer of the hatching zones 60 is smaller than that of the hatching zones 62. The two kinds of hatching zones 60 and 62 alternately appear along a length of the screw member 54*a* at regular intervals, a pitch of which corresponds to a flight pitch of the screw member 54*a*. An appearance of the non-uniform density is derived from the fact that, during the rotation of the screw member 54*a*, the developer cannot be sufficiently fed to a trailing face of the screw flight (54*a*) at the side of the screw member 54*a* adjacent to the partition member 54*c*. In practice, a plurality of cavities discretely appears on an upper surface of the developer held in the vessel 46, at the locations corresponding to the hatching zones 60. Note, during the rotation of the screw member 54*a*, the developer can be sufficiently fed from the bottom side of the vessel 46 to the trailing face of the screw flight (54*a*) at the side of the screw member 54*a* adjacent to the magnetic roller 48, and thus the developer density can be uniformly maintained therein.

If the screw member 54*a* is reversely rotated, as indicated by an arrow RA in FIG. 4(*b*), the developer is propelled in a reverse direction indicated by an arrow RA' in FIG. 4(*b*). In this case, the screw flight of the screw member 54*a* is downwardly moved from the top side of the vessel to the bottom side thereof at the side of the screw member 54*a* adjacent to the magnetic roller 48. Accordingly, the developer entrapped by the screw member 54*a* is downwardly moved from the top side of the vessel 46 toward the bottom side thereof at the side of the screw member 54*a* adjacent to the magnetic roller 48. On the other hand, the entrapped developer is upwardly moved from the bottom side of the vessel 46 toward the top side thereof at the opposite side of the screw member 54*a* adjacent to the partition member 54*c*. Thus, the developer propelled by the screw member 54*a* in the direction indicated by the arrow RA' has a nonuniform density at the side of the screw member 54*a* adjacent to the magnetic roller 48, and a uniform density at the opposite side of the screw member 54*a* adjacent to the partition member 54*c*, as illustrated in FIG. 4(*b*). Namely, in this drawing, a part of the propelled developer having the uniform density is indicated as a hatching zone 58', and a part of the propelled developer having the non-uniform density is indicated as two kinds of hatching zones 60' and 62', Similar to FIG. 4(*a*), a density of developer of the hatching zones 60' is smaller than that of the hatching zones 62'.

When the non-uniform density appears in the developer held in the vessel 46, at the side of the screw member 54*a* adjacent to the magnetic roller 48, as shown in FIG. 4(*b*), an even development of a latent image cannot be ensured because a non-uniform density correspondingly appears in the developer entrained by the magnetic roller 48. However, according to the present invention, as shown in FIG. 4(*a*), the appearance of the uniform density is assured at the side of the screw member 54*a* adjacent to the magnetic roller 48, and thus an even development of a latent image can be ensured. Namely, it is possible to present a uniform density mass of the developer to the magnetic roller 48 by the rotation of the screw member 54*a* in the direction indicated by the arrow in FIG. 3.

In practice, a printing of a toner-solid image on a sheet of paper was made on each of the two cases shown in FIGS. 4(*a*) and 4(*b*). The results are shown in a graph of FIG. 4(*c*), in which the abscissa indicates a distance measured from one side edge of the sheet of paper to the other side edge thereof, and the ordinate indicates a variation of an optical density (OD) of the printed toner-solid image determined along a width of the sheet of paper. In this graph, a curve represented by a plurality of small open circles "o" indicates the case of FIG. 4(*a*), and a curve represented by a plurality of small open triangles "Δ" indicates the case of FIG. 4(*b*). As apparent from the graph, there is no variation of the optical density in the case of FIG. 4(*a*), whereas the optical density periodically varies in the case of FIG. 4(*b*). Note, a distance indicated by reference P in the graph of FIG. 4(*c*) corresponds to a screw flight pitch of the screw member 54*a*.

Another advantage or merit can be obtained by the rotation of the screw member 54*a* in the direction indicated by the arrow A. In particular, the developer removed from the magnetic roller 48 at the non-magnetic field zone produced by the two adjacent magnet elements M5 and M1 has a small content of the toner component because the toner component of the removed developer is consumed for development of a latent image. For this reason, the removed developer should not be directly fed to the magnetic roller 48 so that a proper development of a latent image can be maintained. According to the present invention, the direct feed of the removed developer to the magnetic roller 48 can be suppressed because the developer entrapped by the screw member 54*a* is upwardly moved from the bottom side of the vessel 46 to the top side thereof at the side of the screw member 54*a* adjacent to the magnetic roller 48. Note, if the screw member 54*a* is reversely rotated in the direction indicated by the arrow RA in FIG. 4(*b*), the direct feed of the removed developer to the magnetic roller 48 is facilitated because, of course, the developer entangled by the reversely-rotating screw member 54*a* is downwardly moved from the top side of the vessel 46 toward the bottom side thereof at the side of the screw member 54*a* adjacent to the magnetic roller 48.

Figure 5A:
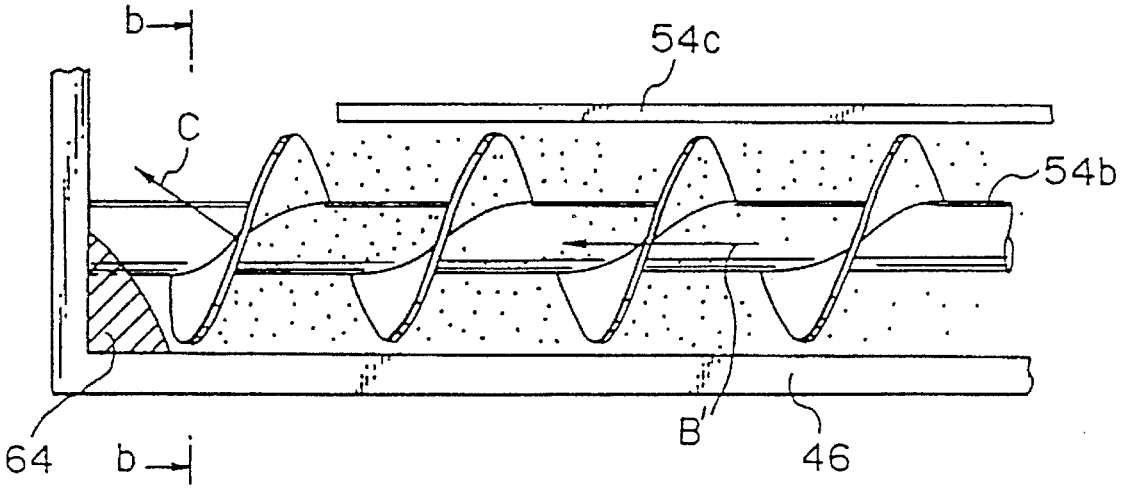
FIG. 5(*a*) is a partial plan view showing an arrangement of a screw member according to the present invention.
Figure 5B:
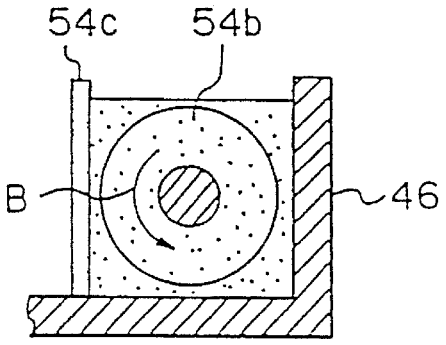

According to another aspect of the present invention, the developing device 18 is arranged such that the developer propelled by the screw member 54*a*, 54*b* cannot exert a pressure on a dead stock of developer which is produced at a corner involved in the passages for circulating the developer. In particular, as shown in FIG. 5(*a*), a section of the developer-circulating passage defined by the screw member 54*b* involves a corner indicated by reference numeral 64, and a dead stock of developer is produced at this corner 64, as indicated by hatching. The screw member 54*b* is rotated in the direction indicated by the arrow B in FIG. 5(*b*), so that the developer is propelled in the direction indicated by the arrow B' in FIG. 5(*a*). Nevertheless, the dead stock of developer cannot be subjected to a large pressure from the developer propelled by the screw member 54*b* because a propellant force which acts on the developer by the leading face of the screw flight (54*b*) is directed in a direction indicated by an arrow C in FIG. 5(*a*).

Figure 6A:
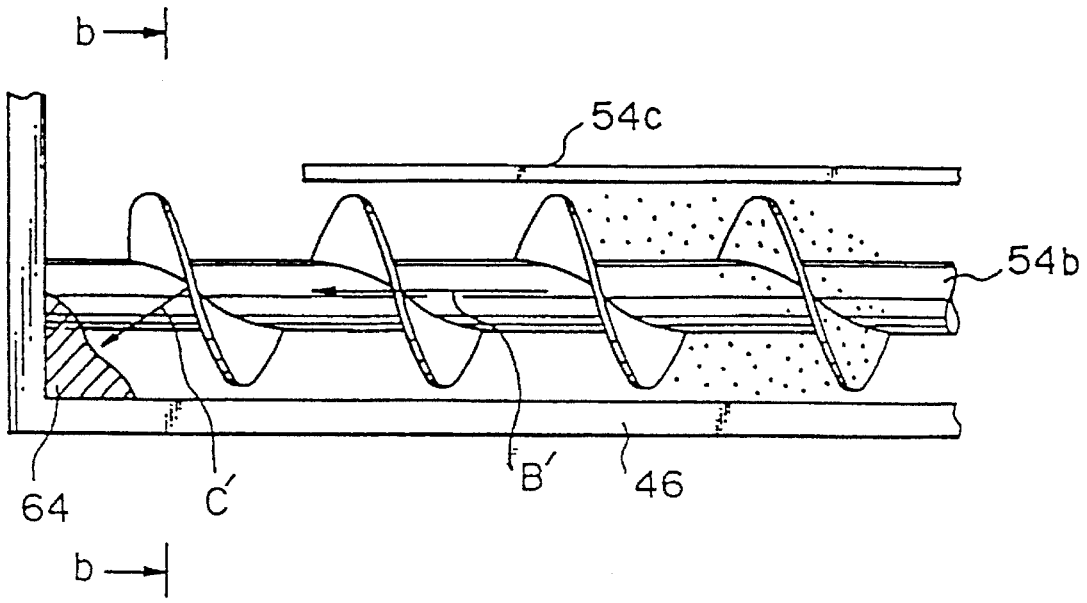
FIG. 6(*a*) is a partial plan view showing an arrangement of a screw member unlike that of the present invention.
Figure 6B:
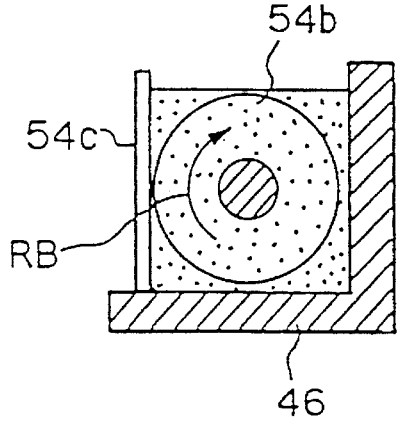
Figure 6C:
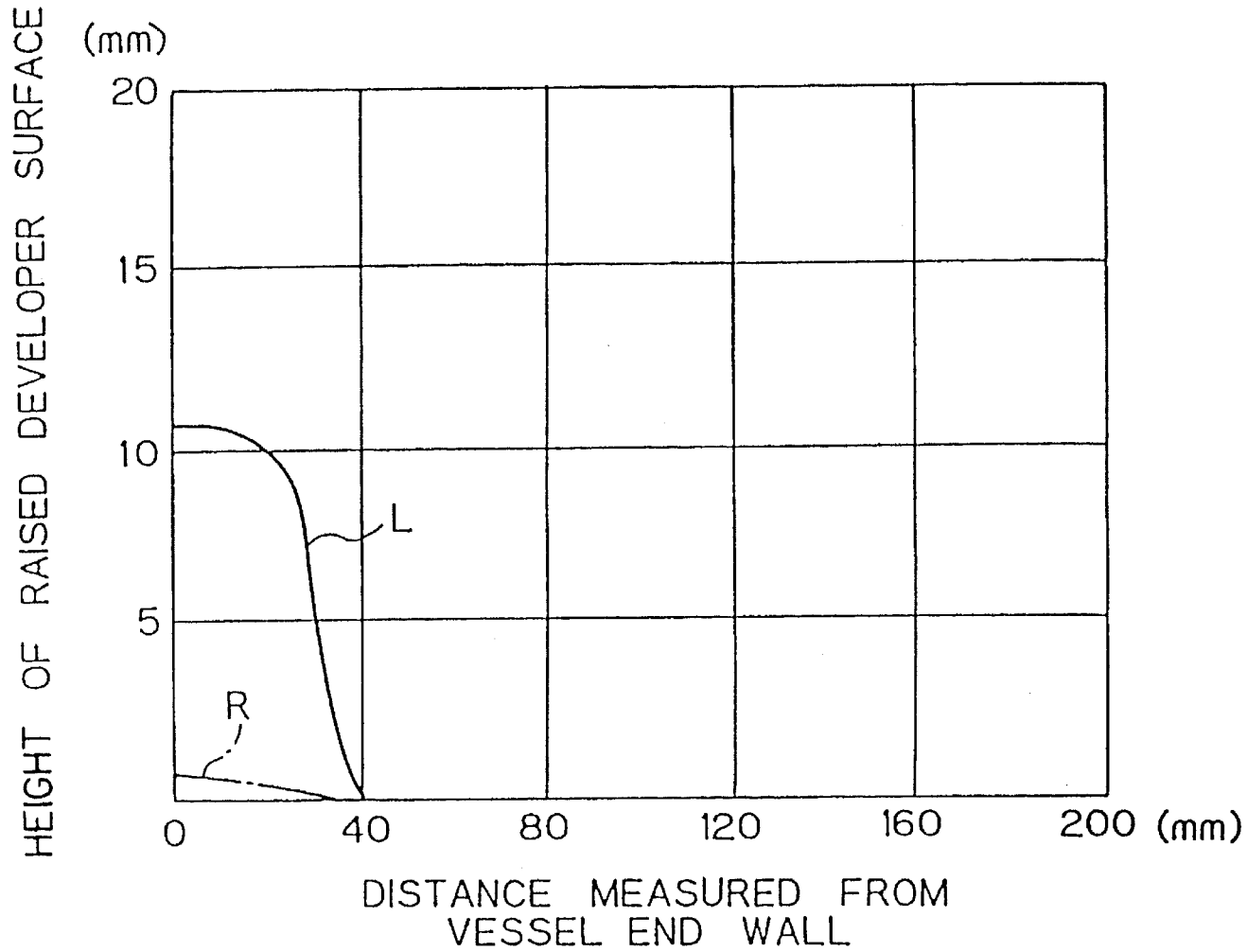

If the screw member 54*b* is provided with a left-hand screw as shown in FIG. 6(*a*), and if it is rotated in a reverse direction indicated by an arrow RB in FIG. 6(*b*), to propel the developer in the same direction indicated by the arrow B', the dead stock of developer produced at the corner 64 is subjected to a large pressure from developer propelled by the screw member 54*b* because a propellant force which acts on the developer by the leading face of the left-hand screw flight (54*b* ) is directed in a direction indicated by an arrow C' in FIG. 5(*a*). Accordingly, the dead stock of developer is compacted to squeeze the toner particles included therein so that each of the magnetic carriers is coated with the squeezed toner material. Also, the dead stock of developer gradually grows into a large mass because a part of the propelled developer is added to the dead stock of developer. When the mass of the dead stock of developer becomes too large, a part of the dead stock of developer is separated therefrom, and is moved into the circulated developer. Thus, the developer held in the vessel 46 is prematurely deteriorated.

In practice, with respect to the two cases of FIG. 5(*a*) and 6(*a*), a test was performed to learn how an upper surface of a developer held in a developer vessel is changed at a corner zone involved in a developer-circulating passage, due to a propellant force of a circulating developer. Note, in the test, a right-hand screw and a left-hand screw, each of which has a shaft diameter of 12 mm, a screw flight diameter of 30 mm, and a screw flight pitch of 30 mm, were used and rotated at 120 rpm, and the vessel is filled with the developer up to a top level thereof. The results are shown in a graph of FIG. 6(*c*), in which the abscissa indicates a distance measured from an end wall of the vessel along a side wall thereof (note, these walls define the corner zone concerned), and the ordinate indicates a height of a raised developer surface measured from the top of the vessel. In this graph, a curve L indicates the case of FIG. 6(*a*), and proves that a height of the raised developer surface is about 11 mm when using the left-hand screw, and a curve R indicates the case of FIG. 5(*a*), and proves that a height of the raised developer surface is about 1 mm when using the right-hand screw. Accordingly, the graph proves that the arrangement of FIG. 5(*a*) according to the present invention is superior to that of FIG. 6(*a*).

Also, in practice, with respect to the cases of FIG. 5(*a*) and 6(*a*), a printing test was performed to learn the relationship between a deterioration of developer and the number of printed sheets of paper. The results are as follows:

In the case of FIG. 5(*a*), a proper quality of printed image could be maintained even after the number of printed sheets had exceeded 30,000, whereas, in the case of FIG. 6(*a*), a proper quality of printed image could not be maintained after the number of printed sheets had exceeded 20,000 due to the deterioration of developer.

Figure 7A:
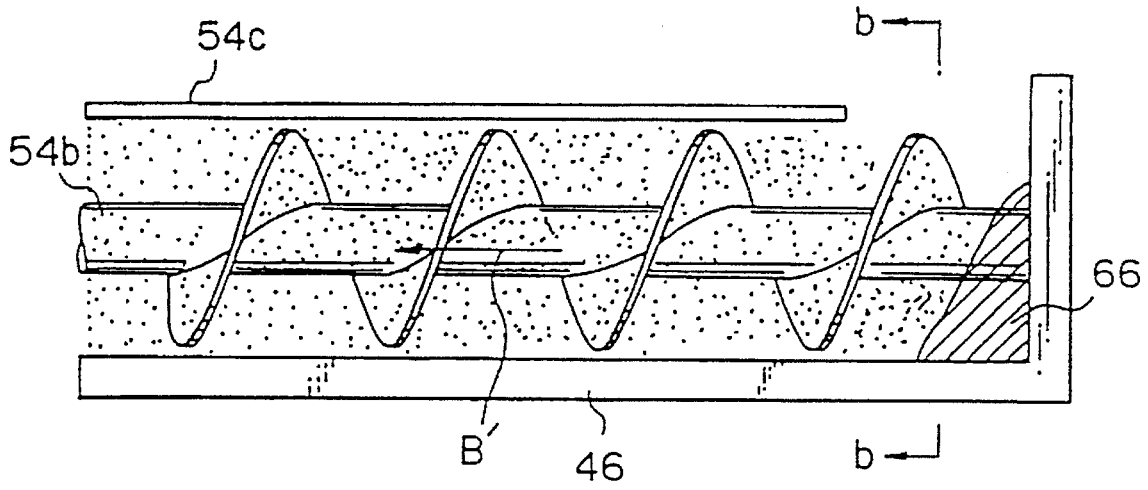
FIG. 7(*a*) is a partial plan view showing another arrangement of a screw member according to the present invention.
Figure 7B:
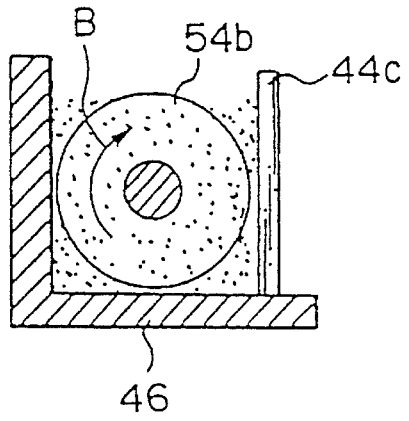
Figure 8A:
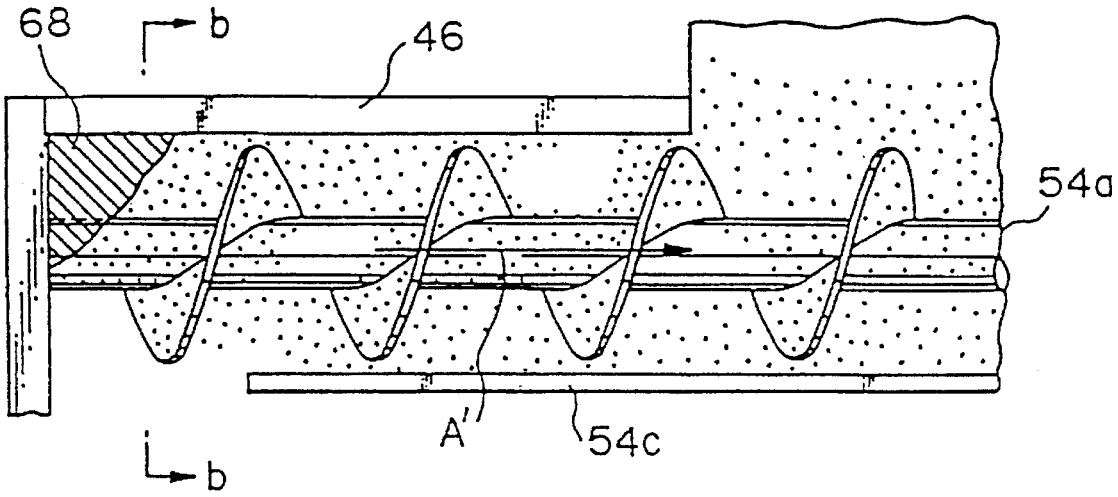
FIG. 8(*a*) is a partial plan view showing yet another arrangement of a screw member according to the present invention.
Figure 8B:
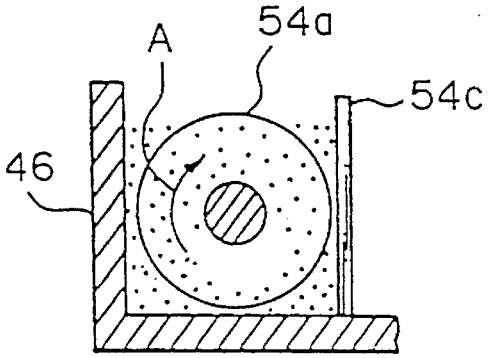

As shown in FIG. 7(*a*), another section of the developer-circulating passage defined by the screw member 54*b* involves a corner indicated by reference numeral 66, and a dead stock of developer is produced at this corner 66, as indicated by hatching. However, this dead stock of developer cannot be subjected a pressure from the circulated developer because the screw member 54*b* is rotated in the direction indicated by the arrow B (FIG. 7(*b*)), so that the developer is propelled in the direction indicated by the arrow B'. Also, as shown in FIG. 8(*a*), yet another section of the developer-circulating passage defined by the screw member 54*a* involves a corner indicated by reference numeral 68, and a dead stock of developer is produced at this corner 68, as indicated by hatching. However, this dead stock of developer also cannot be subjected a pressure from the circulated developer because the screw member 54*a* is rotated in the direction indicated by the arrow A (FIG. 8(*b*)), so that the developer is propelled in the direction indicated by the arrow A'.

Figure 9:
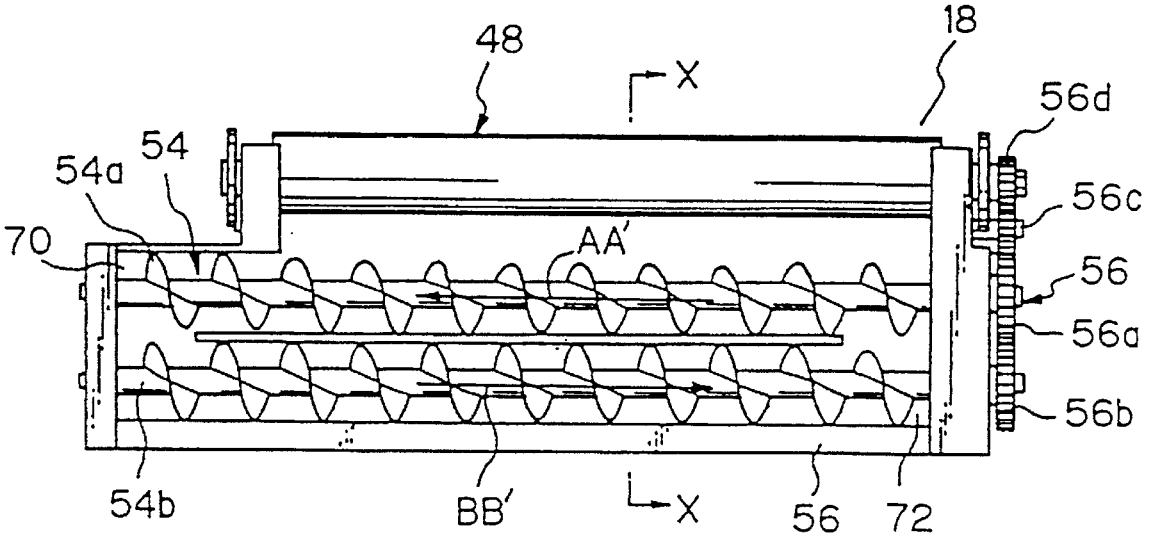
FIG. 9 is a plan view showing a modification of the developing device of FIG. 2.
Figure 10:
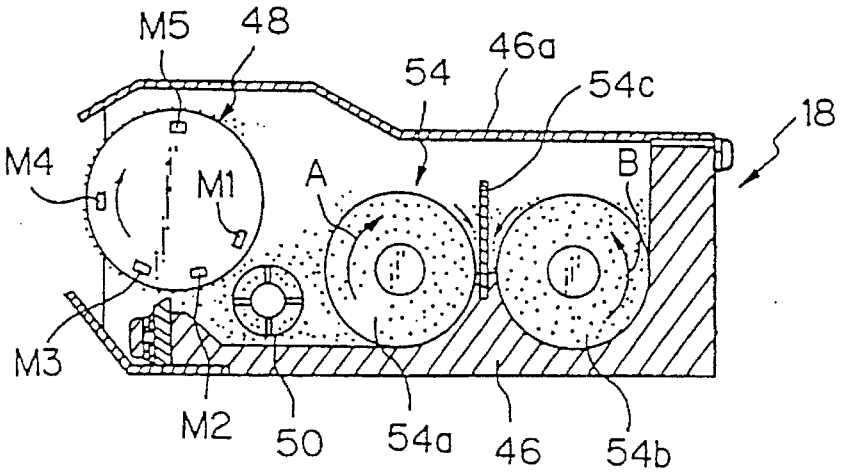
FIG. 10 is a cross-sectional view taken along line X—X of FIG. 9.

FIGS. 9 and 10 show a modification of the developing device 18 shown in FIGS. 2 and 3, and this modified embodiment is identical to that of FIGS. 2 and 3 except that each of the screw members 54*a* and 54*b* is provided with a left-hand flight. Similar to the embodiment of FIGS. 2 and 3, the screw member 54*a* is rotated in the direction indicated by the arrow A in FIG. 10, so that a developer entrapped thereby is propelled in a direction indicated by an arrow AA' in FIG. 9. Also, when the screw member 54*b* is rotated as indicated by the arrow B, a developer entrapped thereby is propelled in a reverse direction indicated by an arrow BB' in FIG. 2. Thus, a part of the developer held in the vessel 46 is always circulated along the developer passages defined by the screw members 54*a* and 54*b*. During the rotation of the screw member 54*a*, the screw flight thereof is upwardly moved from the bottom side of the vessel 46 toward the top side thereof at the side of the screw member 54*a* adjacent to the magnetic roller 48, so that the developer entrapped by the screw member 54*a* is upwardly moved from the bottom side of the vessel 46 to the top side thereof at the side of the screw member 54*a* adjacent to the magnetic roller 48, whereby the developer propelled by the screw member 54*a* in the direction indicated by the arrow AA' has a uniform density at the side of the screw member 54*a* adjacent to the magnetic roller 48, and thus an even development of a latent image can be ensured. Also, the developer-circulating passages defined by the screw members 54*a* and 54*b* involve two corners indicated by reference numerals 70 and 72, respectively, and a dead stocks of developer is produced at each of the corners 70 and 72. Nevertheless, the dead stock of developer cannot be subjected to a large pressure from the propelled developer because a propellant force which acts on the developer by the leading face of the left-hand screw flight is not directed to the dead stock of developer, as apparent from FIG. 9.

Figure 11A:
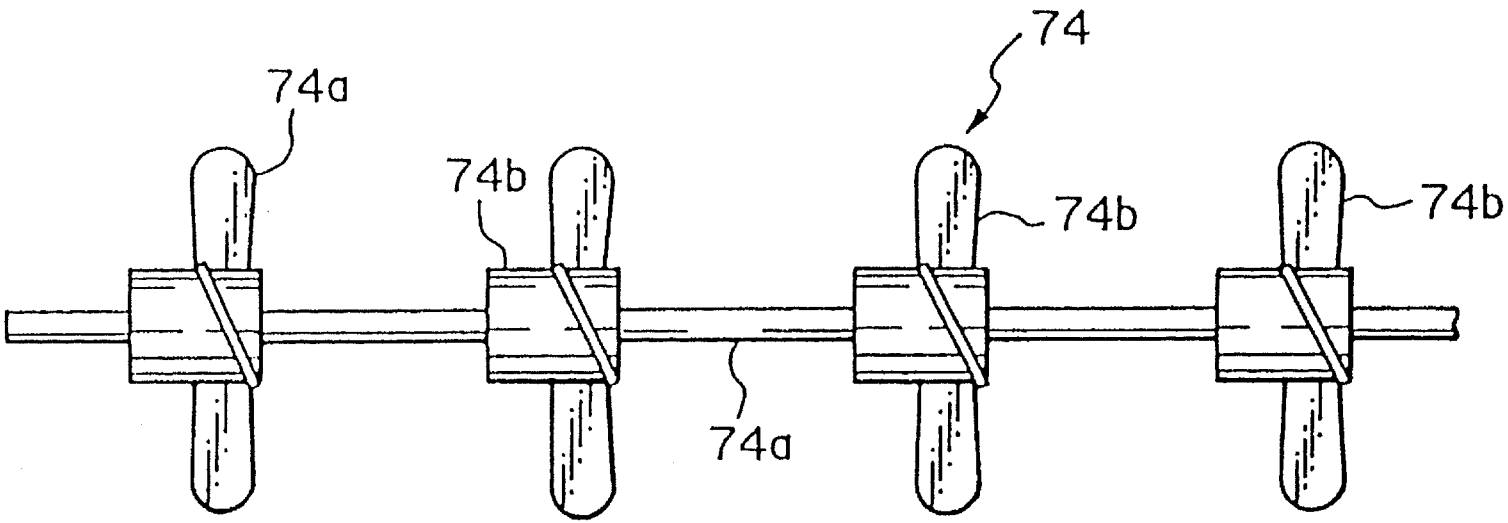
FIG. 11(*a*) is a plan view showing a multi-propeller member which may be substituted for a screw member of the developing device shown FIGS. 2 and 3.
Figure 11B:
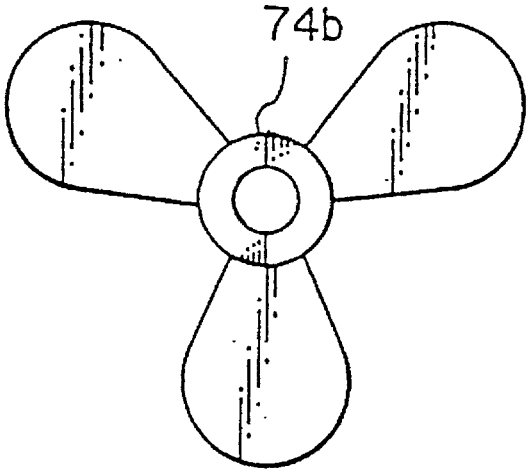
Figure 11C:
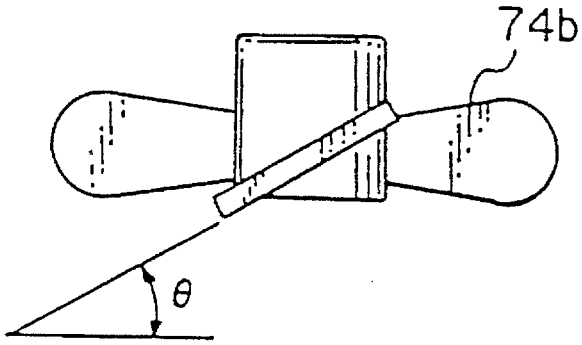

FIG. 11(*a*) shows a multi-propeller member 74 which may be substituted for the screw member 54*a*, 54*b* in the above-mentioned embodiments. The multi-propeller member 74 includes an elongated shaft element 74*a*, and a plurality of propeller elements 74*b* fixed thereon at regular intervals. Each of the propeller elements 74*b* is provided with three blades, as shown in FIG. 11(*b*), and these blade are identically angled to define a given angle θ with a plane perpendicular to a central axis of the propeller element 74*b*, as shown in FIG. 11(*c*). Accordingly, In place of the screw member 54*a*, 54*b*, the multi-propeller member 74 can be used for propelling the developer. In this case, of course, the multi-propeller member 74 disposed adjacent to the magnetic roller 48 is rotated in such a manner that the blades of the propeller element 74*b* are upwardly moved from the bottom side of the vessel 48 toward the top side thereof. Note, although the illustrated multi-propeller member 74 is arranged as a left-hand flight type, it may be a right-hand flight type.

Figure 12A:
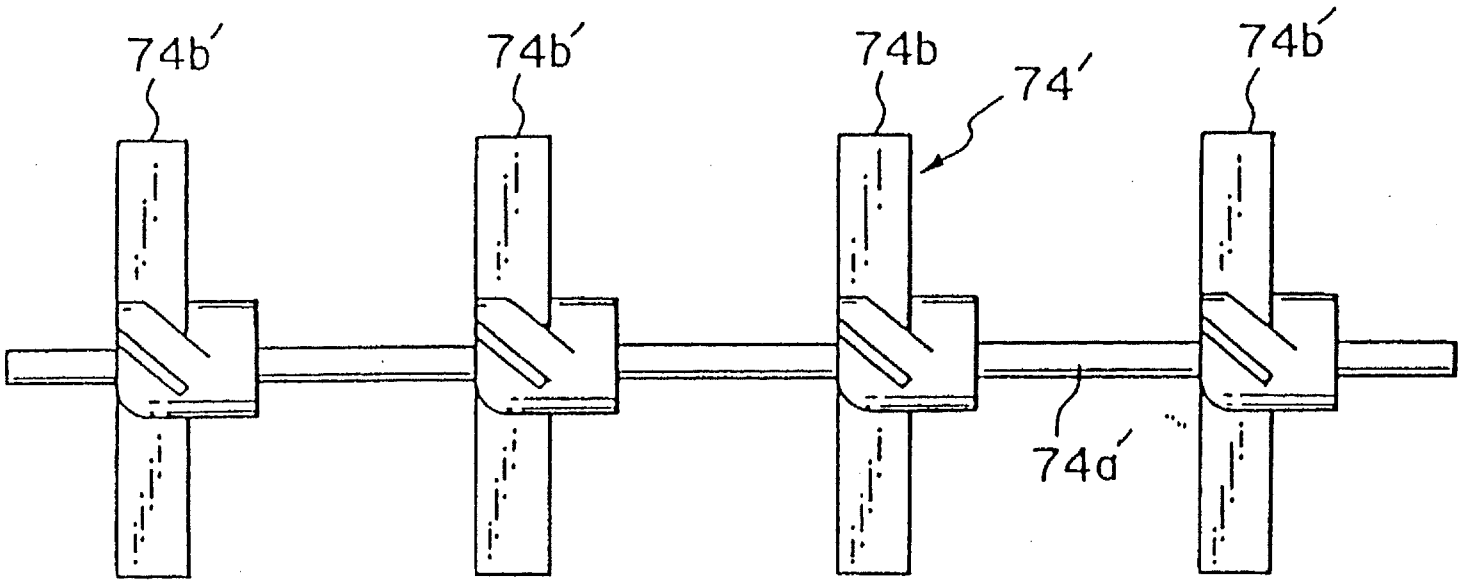
FIG. 12(*a*) is a plan view showing a modification of the multi-propeller member shown in FIG. 11(*a*)
Figure 12B:
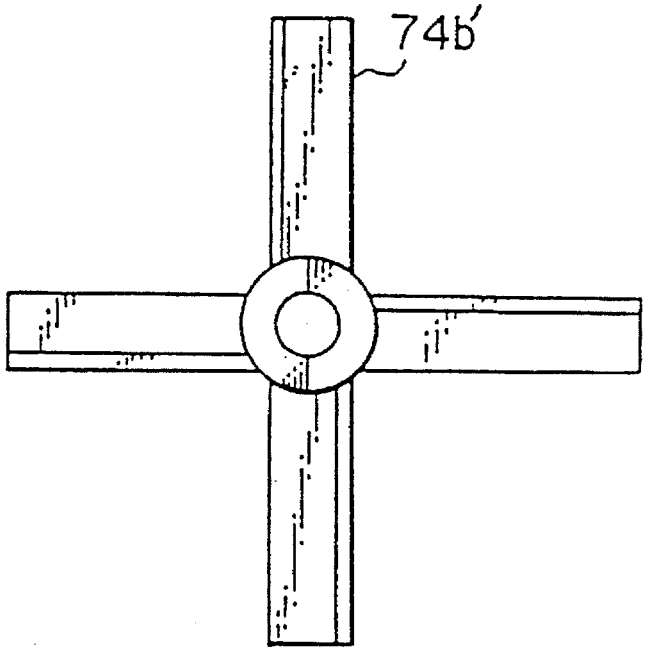
Figure 12C:
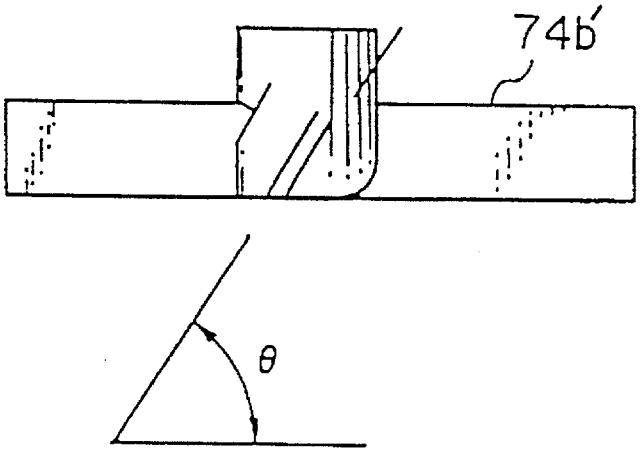

FIGS. 12(*a*), 12(*b*), and 12(*c*) show a modification of the multi-propeller member 74 shown in FIGS. 11(*a*), 11(*b*), and 11(*c*). This modified multi-propeller member 74' has an elongated shaft element 74*a*', and a plurality of propeller elements 74*b*' fixed thereon at regular intervals. Each of the propeller elements 74*b*' is provided with four elongated rectangular blades, as shown in FIG. 12(*b*), and these blade are identically angled to define a given angle 8 with a plane perpendicular to a central axis of the propeller element 74*b*', as shown in FIG. 12(*c*). Similar to the multi-propeller member 74, the modified multi-propeller member 74' can be used in the place of the screw member 54*a*, 54*b*

Figure 13A:
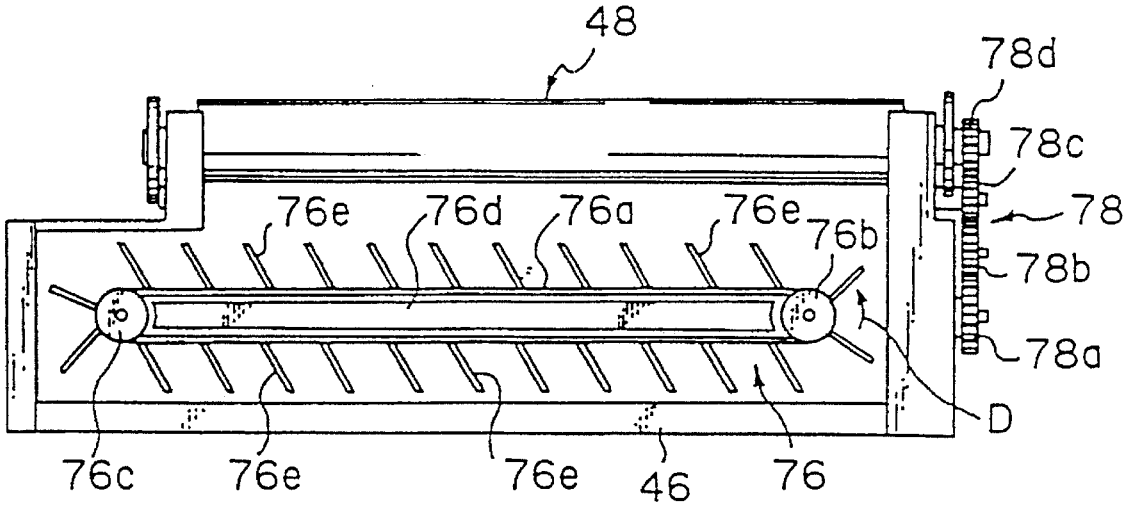
FIG. 13(*a*) is a plan view showing an endless belt type developing device according to the present invention.
Figure 13B:
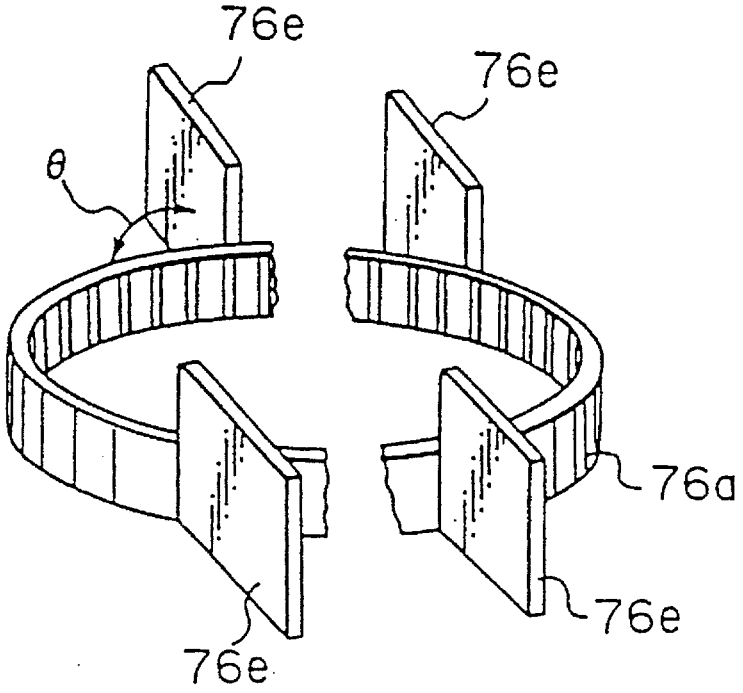
Figure 13C:
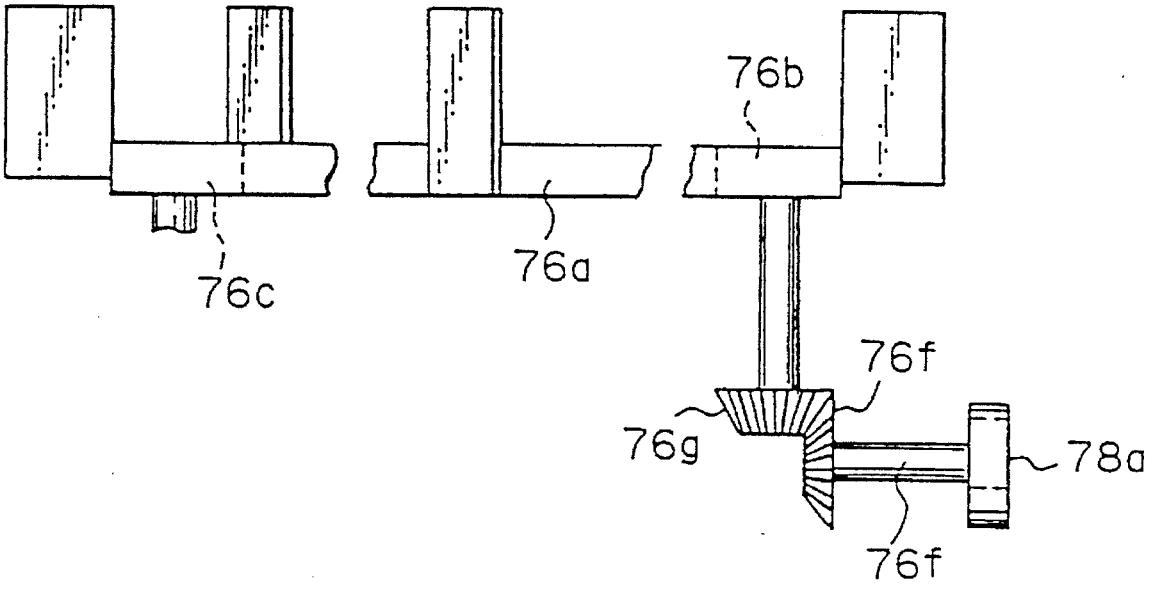

FIG. 13(*a*) shows a second embodiment of a developing device according to the present invention, which is identical to the first embodiment as shown in FIGS. 2 and 3 except that an endless belt type agitator 76 is substituted for the screw type agitator 54. The endless belt type agitator 76 includes an endless belt 76*a* entrained with two pulleys 76*b* and 76*c* which are spaced from each other and displaced on a bottom of the vessel 46 beside the end walls thereof. Each of the pulleys 76*b* and 76*c* has a shaft extended through the bottom of the vessel 46 and rotatably supported thereby, and a partition member 76*d* is fixed on the bottom of the vessel 46 and is extended between the pulleys 76*b* and 76*c* inside of the endless belt 76*a*. The agitator 76 also includes a plurality of blade elements 76*e* attached to the endless belt 76*a* to define a given acute angle θ therewith, as shown in FIG. 13(*b*). During an operation of the developing device, the endless belt 76*a* is rotated in a direction indicated by an arrow D in FIG. 13(*a*), in such a manner that a part of the developer held in the vessel 46 is received in acute angle spaces between the endless belt 76*a* and the blade elements 76*e*. Thus, a part of the developer held in the vessel 46 is always circulated along the rotating endless belt 76*a*, whereby not only can the toner component be sufficiently charged by a triboelectrification with the magnetic component, but also a uniform distribution of the toner component in the magnetic component can be ensured. According to this second embodiment, a constant density can be given to a part of the developer fed from the endless belt type agitator 76 to the magnetic roller 48. Namely, it is possible to present a uniform density mass of the developer to the magnetic roller 48.

To rotate the endless belt 76*a*, a gear train 78 is provided on one end wall of the vessel 46, as shown in FIG. 13(*a*). The gear train 78 includes a gear 78*a* fixed on one end of a shaft 76*f* (FIG. 13(*c*)) extended through the end wall of the vessel 46, and the end of the shaft has a bevel gear 76*f* fixed thereon, which is engaged with a bevel gear 76*g* fixed on a free end of the shaft of the pulley 76*b*. The gear train 78 further includes a first idler gear 78*b* engaged with the gear 78*a*, a second idler gear 78*c* engaged with the first idler gear 78*b*, and a gear 78*d* engaged with the second idler gear 78*c* and provided to drive the magnetic roller 48. With this arrangement of the gear train 78, when the gear 78*d* is subjected to a rotational drive force from the main motor 44 (FIG. 1) through a drive mechanism (not shown) so that the magnetic roller 48 is driven in the manner as shown in FIG. 3, the endless belt 76*a* can be be rotated in the direction indicated by the arrow D.

Figure 14:
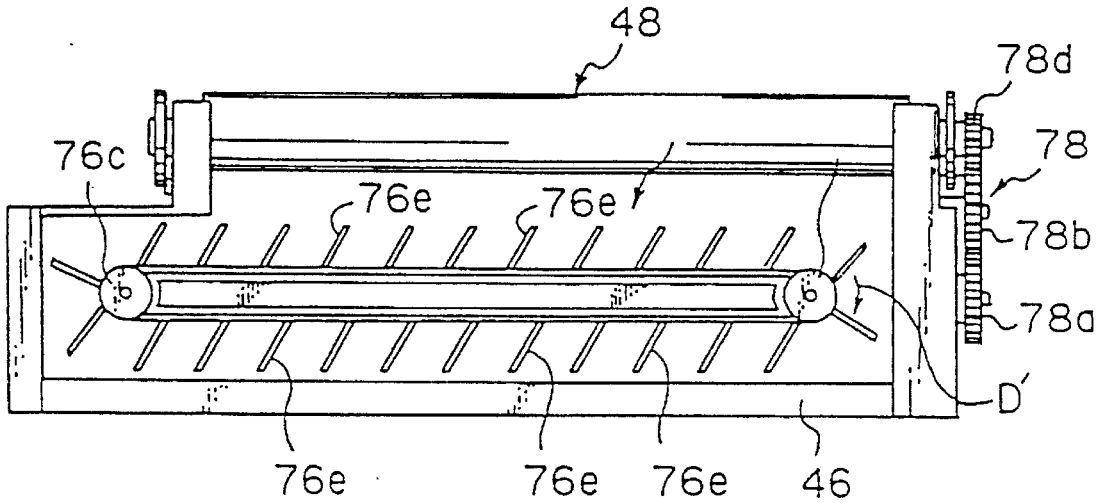
FIG. 14 is a plan view showing a modification of the endless belt type developing device shown in FIG. 13(*a*)

FIG. 14 shows a modification of the developing device as shown in FIGS. 13(*a*), 13(*b*), and 13(*c*), and this modified embodiment is identical to that of FIGS. 13(*a*), 13(*b*), and 13(*c*) except that the blade elements 76*e* are reversely oriented with the endless belt 76*a*, and the endless belt 76*a* is rotated in a reverse direction indicated by an arrow D' in FIG. 14. Note, the gear train 78 includes only one idle gear 78*b*' provided between the gears 78*a* and 78*d* for the reverse rotation of the endless belt 76*a*.

As mentioned hereinbefore, the developer entrained by the magnetic roller 48 and passed through the developing zone, i.e., the developer used for a development of a latent image is removed at the non-magnetic field zone produced by the two adjacent magnet elements M5 and M1 (FIG. 3), but an amount of the removed developer is small. Accordingly, the removal of the used developer from the magnetic roller 48 should be carried out to as greater an extent as possible so that a proper development can be maintained. For this reason, the developing device 18 may include a scraper blade member 80 formed of a suitable metal material such as stainless steel, brass, aluminum or the like, as shown in FIG. 15(*a*), and the scraper blade member 80 is provided in the vessel 48 in such a manner that an acute edge of the scraper blade member 80 is tangentially oriented with respect to the magnetic roller 48 to remove the used developer therefrom. In this embodiment, the removed developer is returned to the developer held in the vessel 48, at a location between the magnetic roller 48 and the screw member 54*a*, as indicated by an arrow E in FIG. 15(*a*), and thus a part of the returned developer can be directly fed to the magnetic roller 48. As discussed hereinbefore, since the returned developer has a small content of the toner component, the direct feed of the returned developer to the magnetic roller 48 should be effectively prevented.

In an embodiment shown in FIG. 15(*b*), the scraper blade member 80 is extended to a location close to a side of the screw member 54a adjacent to the magnetic roller 48, and thus the main part of the removed developer can be entrapped by the scraper blade member 80, as indicated by an arrow F in FIG. 15(*b*). Also, in an embodiment shown in FIG. 15(*c*), the scraper blade member 80 is extended to a location close to a top edge of the screw member 54*a* adjacent to the magnetic roller 48, and thus all of the removed developer can be entrapped by the scraper blade member 80, as indicated by an arrow G in FIG. 15(*c*). Accordingly, in the embodiments shown in FIGS. 15(*b*) and 15(*c*), a proper development of a latent image can be maintained over a long period of time.

In practice, a printing of a solid-toner image on a sheet of paper was made with respect to each of the two cases shown in FIGS. 15(*a*) and 15(*b*). The results are shown in a graph of FIG. 15(*d*), in which the abscissa indicates a total length of printed sheet papers, and the ordinate indicates a variation of an optical density (OD) of the printed solid-toner image. In this graph, a curve represented by a plurality of small solid triangles "▲" indicates the case of FIG. 15(*a*), and proves that the optical density of the printed toner-solid image is gradually lowered as the total length of printed sheet papers is increased, whereas a curve represented by a plurality of small open squares "□" indicates the case of FIG. 15(*b*), and proves that there is no variation of the optical density.

Figure 15A:
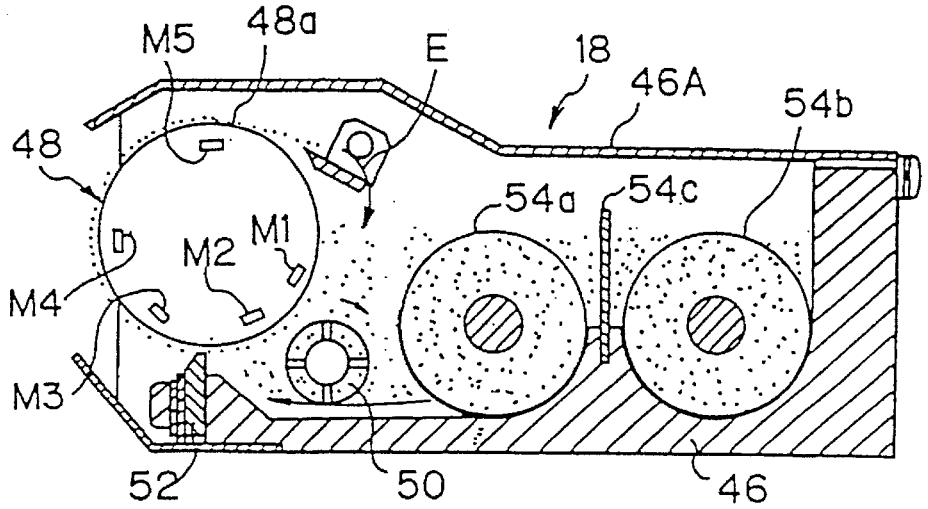
FIG. 15(*a*) is a cross-sectional view of a developing device according to the present invention, including a scraper blade member for removing a developer from a magnetic roller.
Figure 15B:
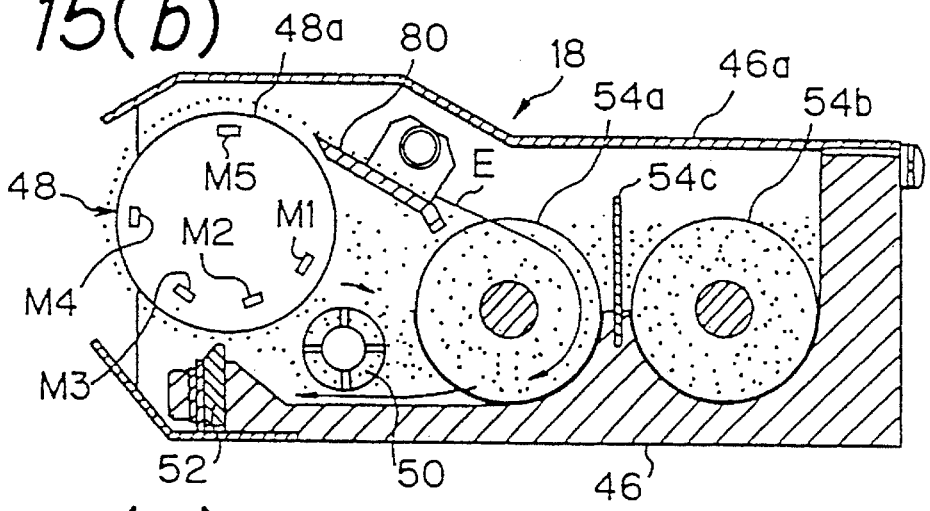
Figure 15C:
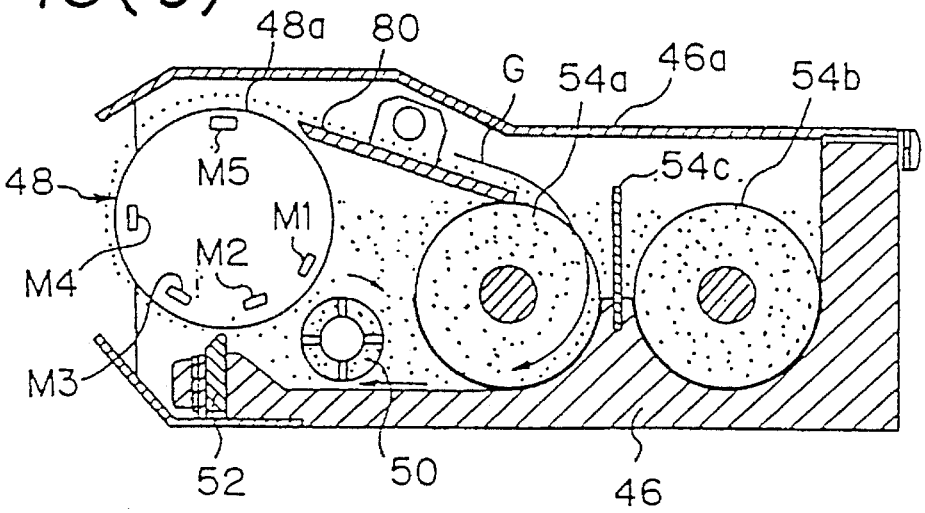
Figure 15D:
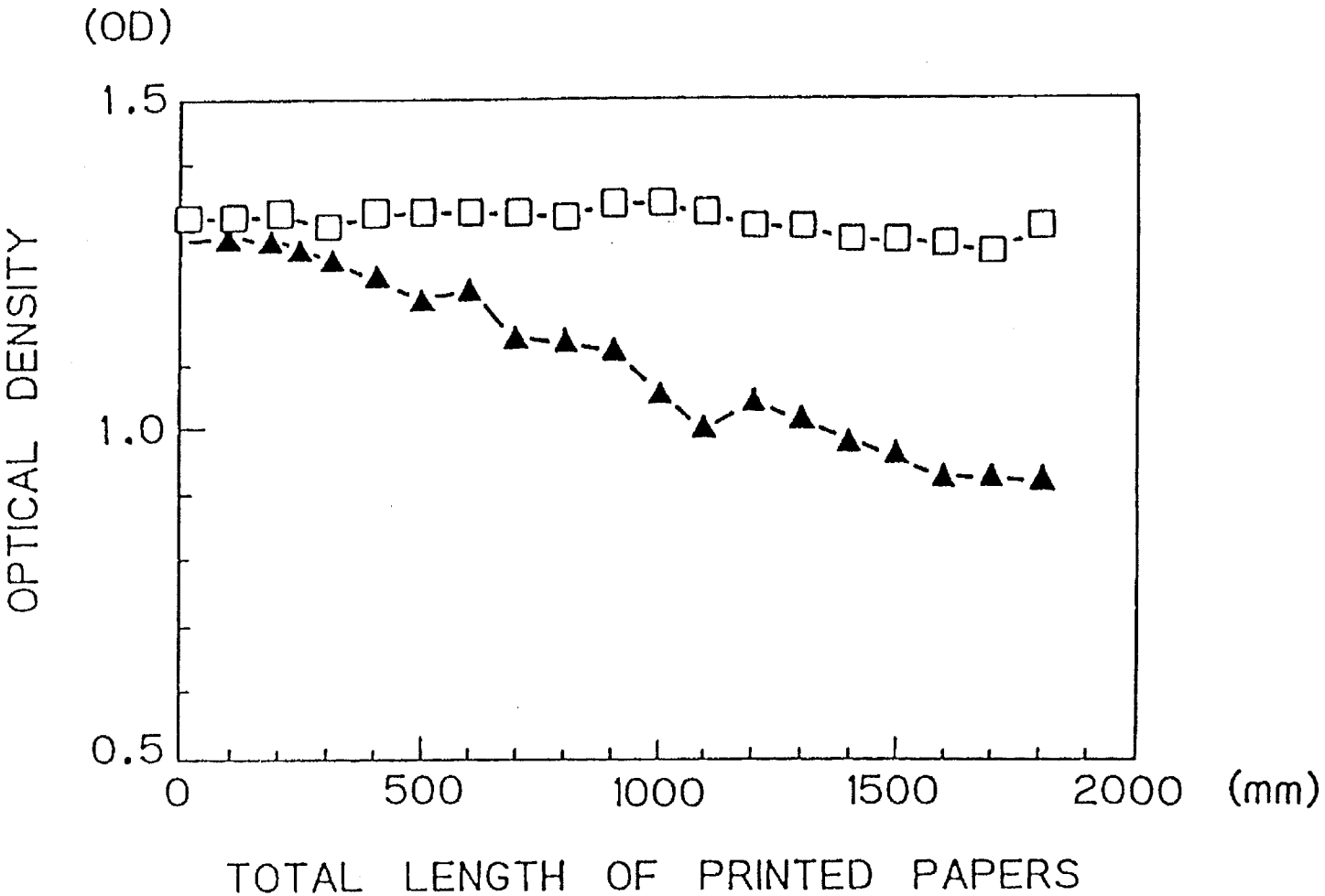

Also, after a printing of a solid-toner image on a sheet of paper was made with respect to each of the two cases shown in FIGS. 15(*a*) and 15(*b*) until a total length of printed sheet papers reaches 2 m, a part of the developer held in the vessel 46 was sampled at each of three locations where the magnetic roller 48, the screw member 54*a*, and the screw member 54*b* are placed, and a content of the toner component in each of the samples was confirmed. The results are shown in the following table:

| | Content of Toner Component (wt %) at Sampling Location (Roller 48, Screw 54a, and Screw 54b) | | | Difference between Roller 48 & |
|---|---|---|---|---|
| Case | Roller 48 | Screw 54a | Screw 54b | Screw 54 |
| FIG.15(a) | 2.27 | 2.99 | 5.02 | 2.72 |
| FIG.15(b) | 4.09 | 4.51 | 4.58 | 0.42 |

Note: Initial Content of Toner Component = 5.5 wt % (No supplement of Toner Component)

Figure 16:
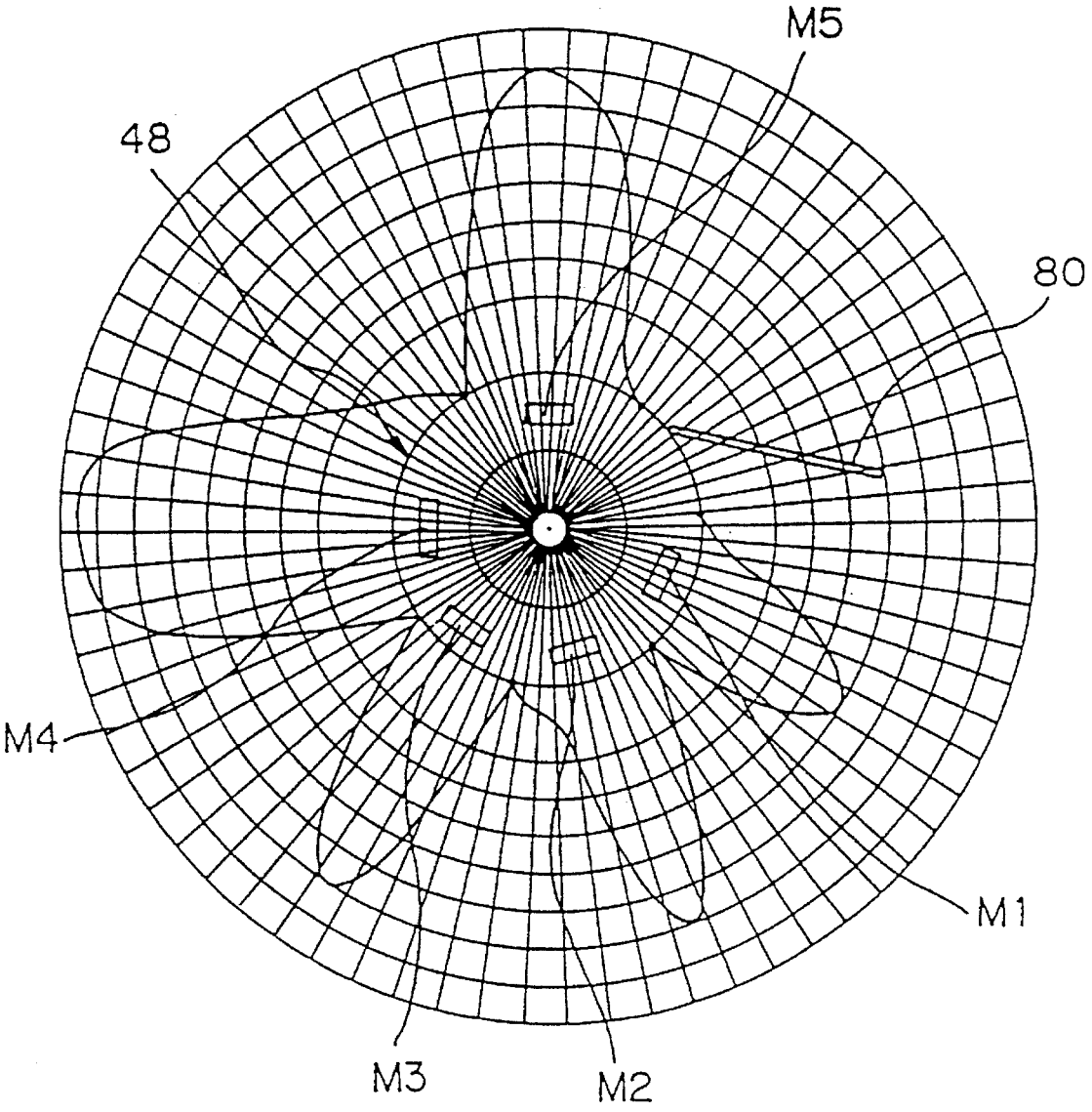
FIG. 16 is an illustration showing a distribution of vertical or radial magnetic flux density established around the magnetic roller.
Figure 17:
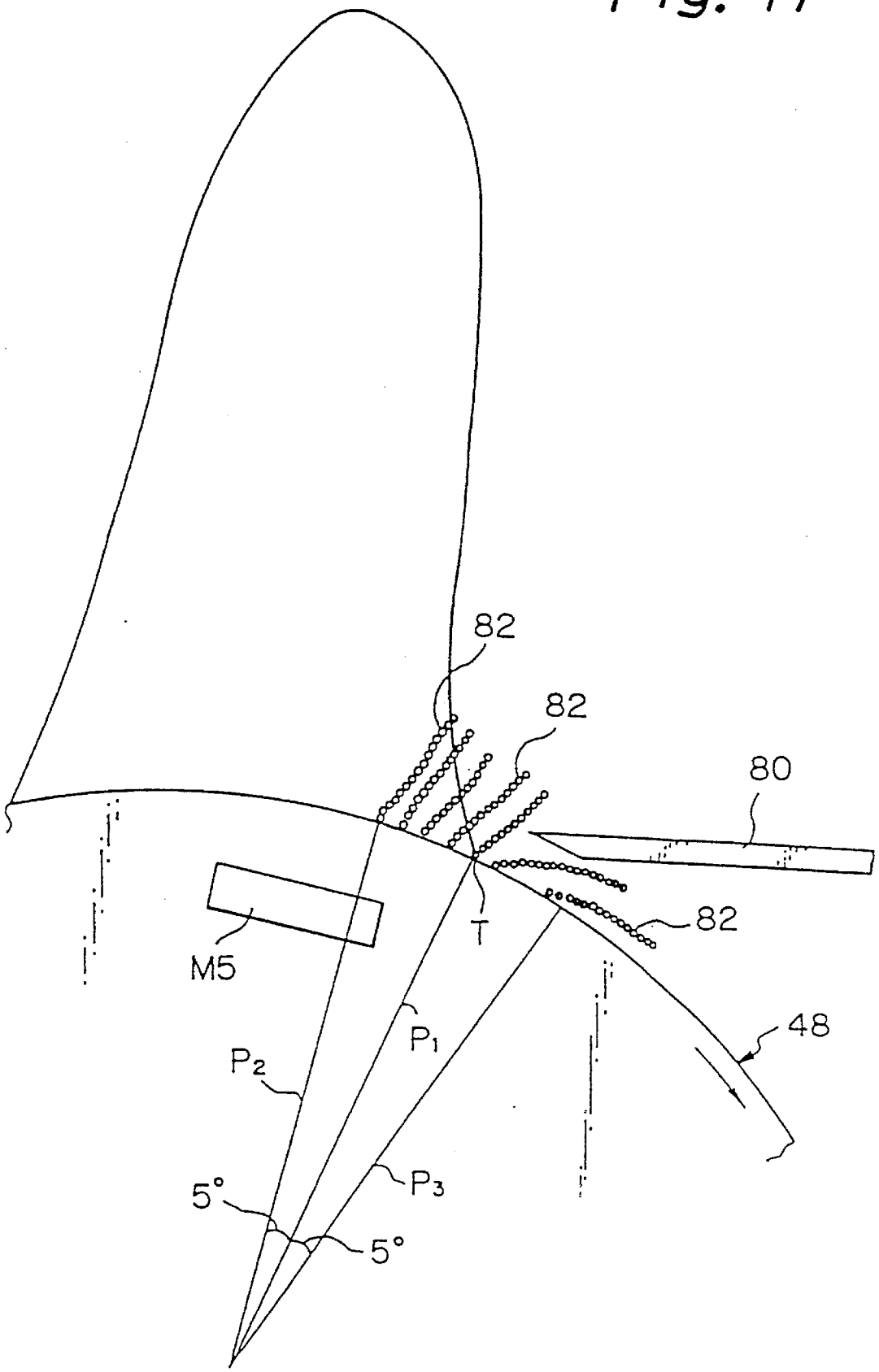
FIG. 17 is an partially enlarged illustration showing the distribution shown in FIG. 16.

The removal of the used developer from the magnetic roller 48 cannot be completely carried out by using the scraper blade member 80, and an efficiency of removal of the used developer depends upon a positional relationship of the scraper blade member 80 with respect to the magnetic roller 48. In particular, as shown in FIG. 16, a distribution of vertical or radial magnetic flux density is established around the magnetic roller 48, and a radial magnetic flux density is substantially zero in the non-magnetic field zone produced by the two adjacent magnetic elements M5 and M1. Accordingly, as illustrated in FIG. 17, as soon as a spike-like element 82 of the magnetic brush formed around the magnetic roller 48 passes through a transition TR at which a radial magnetic flux density is zero, the spike-like element 82 falls down on the surface of the magnetic roller 48. It is difficult to scrape the fallen-down spike-like elements 82 without damaging the surface of the magnetic roller 48, and also scraping of the upright spike-like elements 82 is difficult due to the magnetic-adhesion thereof to the roller surface (48).

In practice, a test for removing used developer was performed for three cases as follows Case I:

An edge of a scraper blade is positioned on a first radial plan $P_1$ (FIG. 17) extended from a central axis of a magnetic roller through a transition TR as defined above, and a gap between the scraper blade edge and the magnetic roller surface is variously changed.

Case II:

The edge of the scraper blade is positioned on a second radial plan $P_2$ (FIG. 17) extended from the central axis of the magnetic roller through a magnetic field producing zone to define an angle of 5 degrees with the first radial plan $P_1$, and a gap between the scraper blade edge and the magnetic roller surface is variously changed.

Case III:

The edge of the scraper blade is positioned on a third radial plan $P_3$ (FIG. 17) extended from the central axis of the magnetic roller through a non-magnetic field zone to define an angle of 5 degrees with the first radial plan $P_1$, and a gap between the scraper blade edge and the magnetic roller surface is variously changed.

Figure 18:
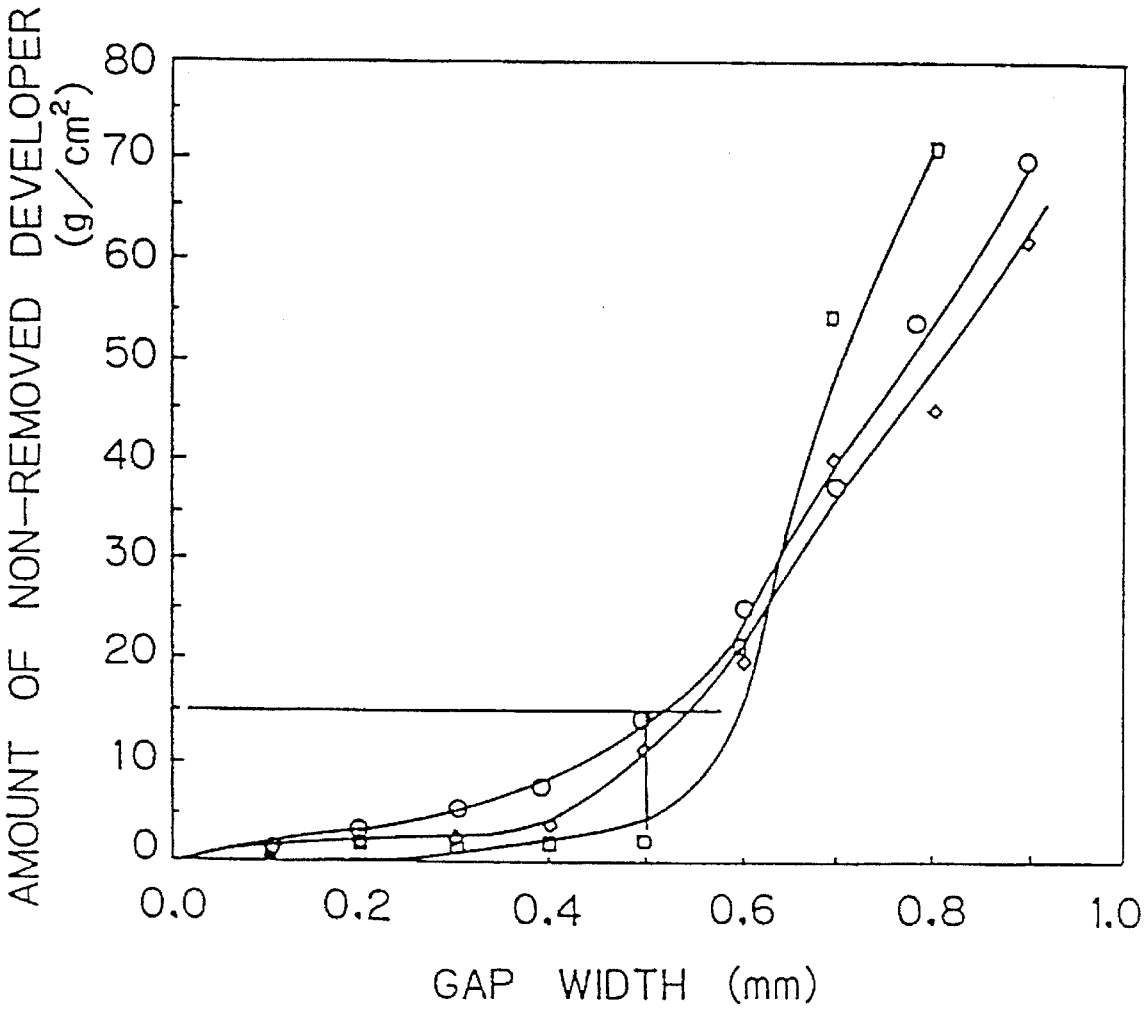
FIG. 18 is a graph showing a relationship between an amount of non-removed developer and a gap width between an acute edge of the scraper blade member and the magnetic roller.

The results are shown in a graph of FIG. 18, in which the abscissa indicates a width of the gap between the scraper blade edge and the magnetic roller surface, and the ordinate indicates an amount of developer not removed from the magnetic roller. In this graph, a curve represented by a plurality of small open squares "□" indicates Case I; a curve represented by a plurality of small open circles "○" indicates Case II; and a curve represented by a plurality of small solid circles "●" indicates Case III. As apparent from the graph, when the width of the gap is more than 0.5 mm, an amount of the non-removed developer is abruptly increased. An amount of the non-removed developer must be at most 15 $g/cm^2$ before a proper development of a latent image can be maintained.

Therefore, in the embodiments shown in FIG. 15(*a*), 15(*b*), and 15(*c*), the scraper blade member 80 should be arranged such that the acute edge thereof is positioned to be close on the transition TR to form a gap width of at most 0.5 mm with the surface of the magnetic roller 48, before an efficient removal of the used developer can be carried out.

Figure 19:
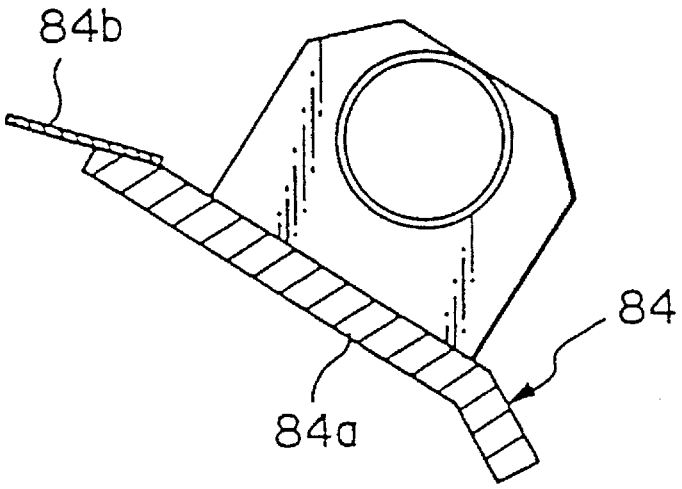
FIG. 19 is a cross-sectional view showing another embodiment of the scraper blade having a film edge element attached thereto.

FIG. 19 shows another embodiment of scraper blade member, generally indicated by reference 84, which may be used in place of the scraper blade member 80. This type scraper blade member 84 has a rigid blade body 84, and a film edge element 84*b* attached to and extended along one side thereof, and is provided in the vessel 46 in such a manner that the film-like edge element 84*a* thereof is in contact with the surface of the magnetic roller 48 in vicinity of the transition TR. The film-like scraper member 84*a* has a thickness of at most 0.5 mm corresponding to the gap width with which the acute edge of the scraper blade member 84 is positioned with respect to the magnet roller surface, and thus an efficient removal of the used developer can be carried out. The film-like scraper member 84*a* may be formed of a suitable resin material such as polyurethane rubber, silicone rubber or the like or a suitable metal material such as stainless steel, phosphor bronze or the like.

As apparent from the foregoing, since the toner component of the developer held in the vessel is consumed during the developing process, a toner component must to be supplemented to the developer held in the vessel, if necessary, so that a ratio of the toner component to the developer can fall within a given range to continuously maintain a proper and stable developing process. Accordingly, a content of the toner component in the developer must be properly detected before the supplement of toner component to the developer held in the vessel can be reasonably carried out. To detect the content of the toner component in the developer, a magnetic permeability is usually measured at a fixed location on a bottom of the vessel in which the developer is held. Namely, as the toner component formed of a non-magnetic material is consumed for the development of latent image, the magnetic permeability measured at the fixed location on the vessel bottom becomes larger. Nevertheless, it is difficult to carry out an accurate measurement of the magnetic permeability, especially in the developing device as mentioned above, because the developer is dynamically circulated in the vessel at all times. In particular, a level of the developer held in vessel is fluctuated due to the dynamic circulation thereof, so that a density of the developer is changed at the fixed or measurement location on the vessel bottom to thereby cause a variation of the magnetic permeability, and thus achievement of an accurate measurement is very difficult or impossible. Note, when a density of the developer is high, the magnetic permeability thereof is large due to a close congregation of the magnetic carriers and vice versa.

Figure 20A:
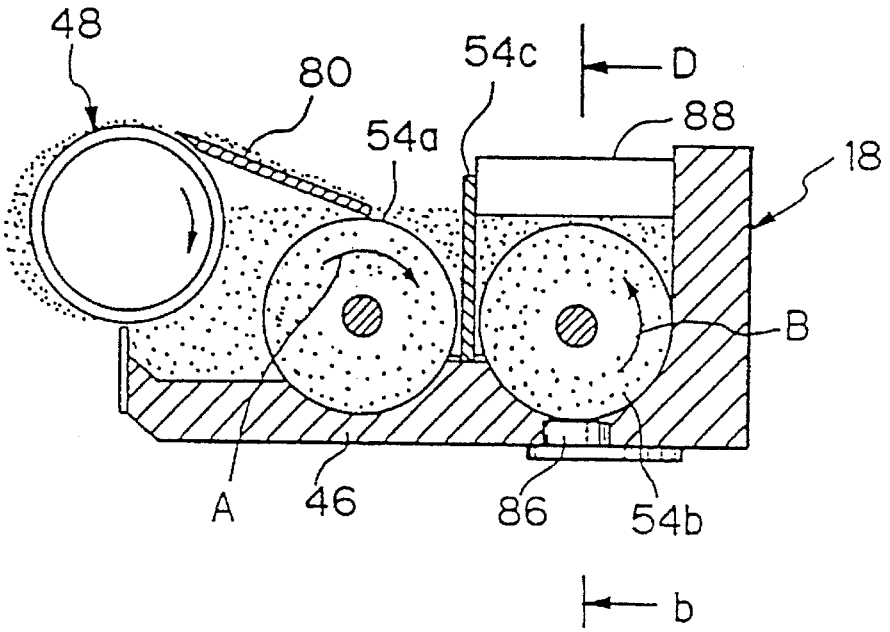
FIG. 20(*a*) is a cross-sectional view taken along line a—a of FIG. 20(*b*), showing a developing device having a barrage plate member for uniformly regulating an upper level of a developer to achieve a proper measurement of a magnetic permeability thereof.
Figure 20B:
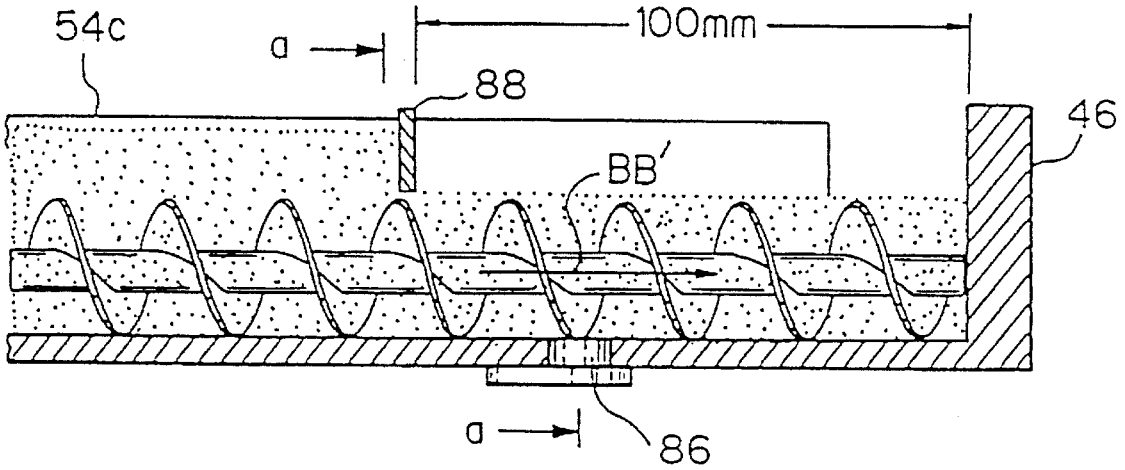

In an embodiment shown in FIGS. 20(*a*) and 20(*b*), the developing device 18 is arranged such that an accurate measurement of a magnetic permeability for detecting a content of the toner component in the developer held in vessel 46 can be ensured. In particular, the developing device 18 is provided with a permeameter 86 incorporated into the bottom of the vessel 46 at a zone in which the screw member 54*b* is located, as shown in FIGS. 20(*a*) and 20 (*b*), and the permeameter 86 measures a permeability of the developer at a fixed location on the vessel 46. The developing device 18 is further provided with a barrage plate member 88 bridged between and supported by a side wall of the vessel 46 and the partition member 54*c* to uniformly regulate an upper level of the developer propelled by the screw member (having the left-hand screw flight) 54*b* in the direction indicated by the arrow BB'. As shown in FIG. 20(*b*), for example, the barrage plate member 88 is displaced at a distance of 100 mm from an end wall of the vessel 46, and the permeameter 86 is positioned at a location downstream with respect to the barrage in the propellant direction (BB') of the developer. With this arrangement, a level of the propelled developer is constant at the location at which the permeameter 86 is positioned, whereby a content of the toner component in the developer can be accurately detected and measured.

Figure 21A:
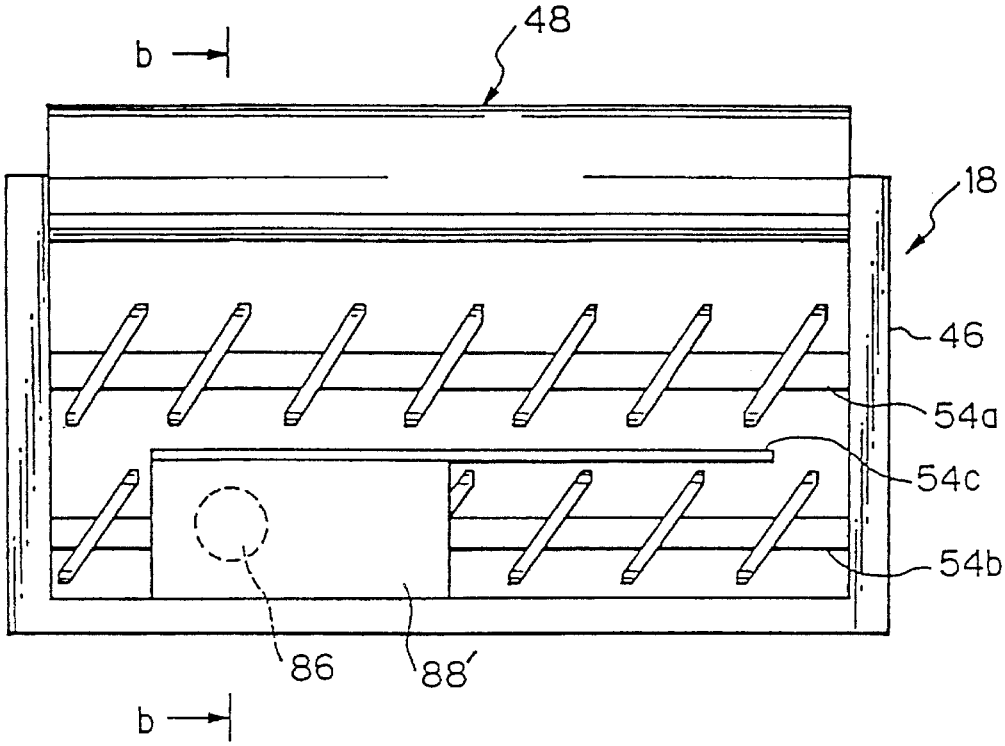
FIG. 21(*a*) is a plan view showing a developing device having a barrage block member for obtaining a uniform mass of a developer to achieve a proper measurement of a magnetic permeability thereof.
Figure 21B:
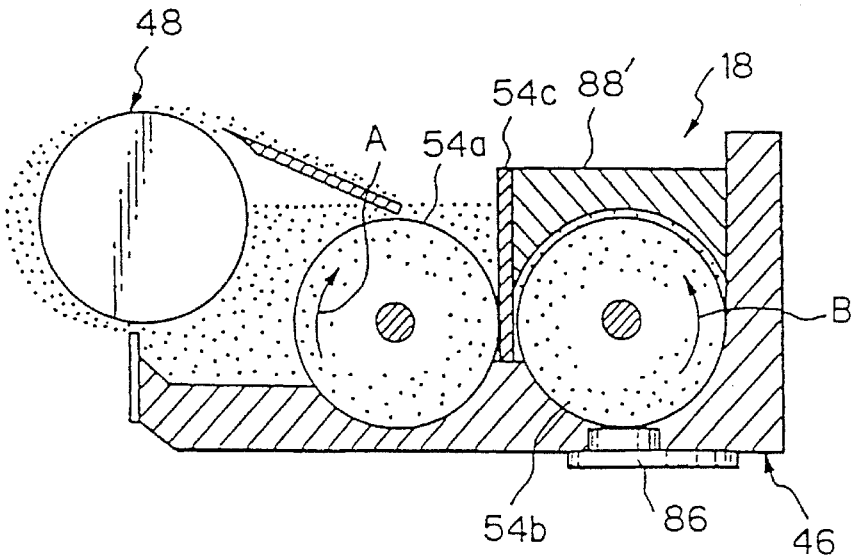

In an embodiment shown in FIGS. 21(*a*) and 21(*b*), the developing device 18 also is arranged such that an accurate measurement of a magnetic permeability for detecting a content of the toner component in the developer held in vessel 46 can be ensured. Note, in FIGS. 21(*a*) and 21(*b*), the screw members 54*a* and 54*b* having the right-hand screw flight are rough illustrated. In this embodiment, the permeameter 86 also is incorporated into the vessel bottom at a zone in which the screw member 54*b* is located, but a barrage block member 88' is used in place of the barrage block member 88 of the embodiment shown in FIGS. 20(*a*) and 20(*b*). As shown in FIG. 21*b*, the barrage block member 88' has a semi-cylindrical concave surface formed a lower side thereof to complementarily receive the screw member 54*b*. Accordingly, when the propelled developer is passed through a passage section defined by the barrage block member 88', the passed developer has a uniform cross section. Namely, a mass of the developer passed through the passage section is kept constant. Thus, a proper and accurate measurement of a magnetic permeability can be ensured by the permeameter 86 displaced below the barrage block member 88'.

Figure 22A:
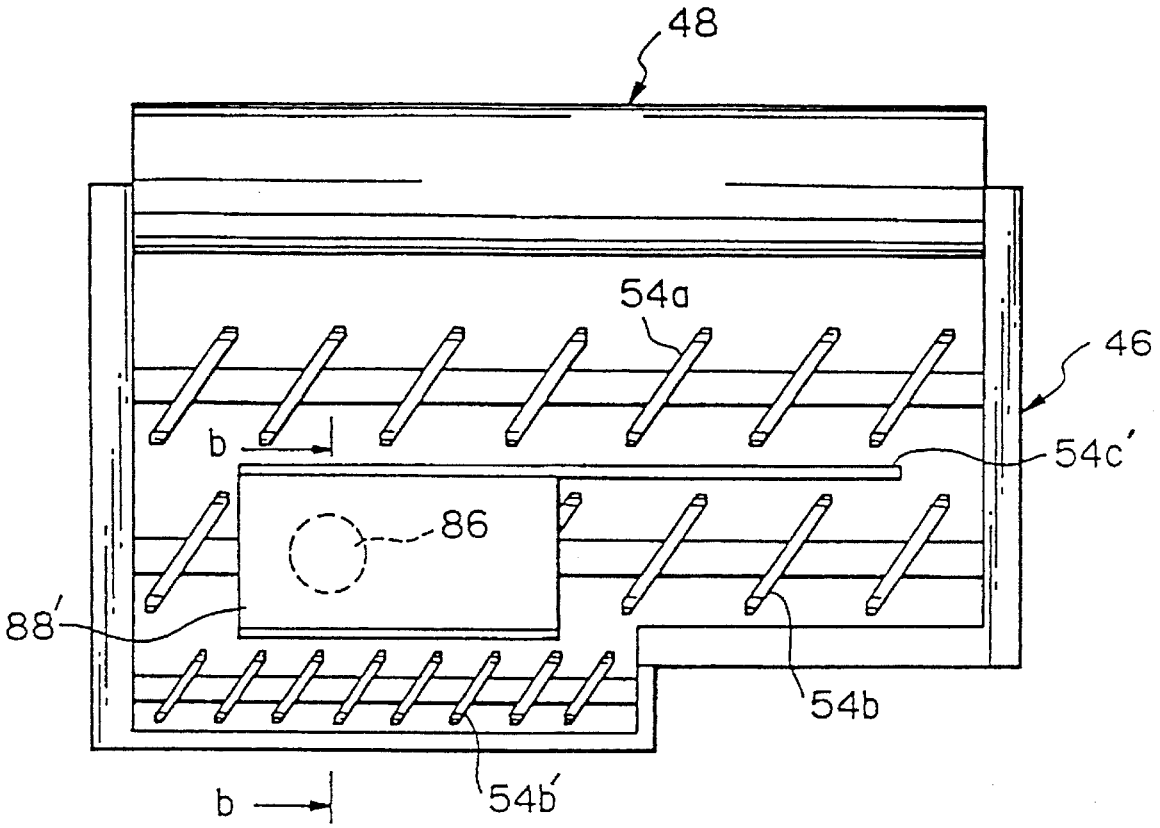
FIG. 22(*a*) is a plan view showing a modification of the developing device shown in FIGS. 21(*a*) and 21(*b*)
Figure 22B:
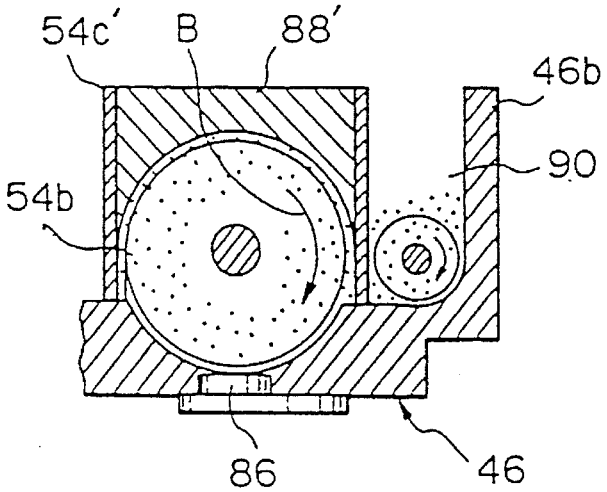

FIGS. 22(*a*) and 22(*b*) show a modification of the embodiment shown in FIGS. 21(*a*) and 21(*b*). This modified developing device 20 is identical to that of FIGS. 21(*a*) and 21(*b*) except that a bypass passage 90 is provided beside the barrage block member 88' to bypass a part of the developer propelled by the screw member 54*b*. In particular, the bypass passage 90 is defined by a side wall section 46*b* extended from the vessel 46 and a short partition member 54*c'* disposed along a side of the barrage block member 88' adjacent to the short partition member 54*c'*, and a small screw member 54*b'*is rotatably provided in the bypass passage 90. In this embodiment, the small screw member 54*b'*has a right-hand screw flight similar to the screw member 54*b*, and is rotated the same direction as indicated an arrow in FIG. 22(*b*). With this arrangement, the circulation of the developer can be smoothly carried out without any stagnation of the developer caused due to an existence of the barrage block member 88'.

Note, in the embodiments shown in FIGS. 20(*a*) and 20(*b*), FIGS. 21(*a*) and 21(*b*), and FIGS. 22(*a*) and 22(*b*), although the barrage member 88, 88' is associated with the screw member 54*b*, it may by provided in a section of the developer circulating passage defined by the screw member 54*a*, to uniformly regulate a mass of the developer at a suitable location of the section for a proper measurement of magnetic permeability of the developer mass, if necessary.

Figure 23:
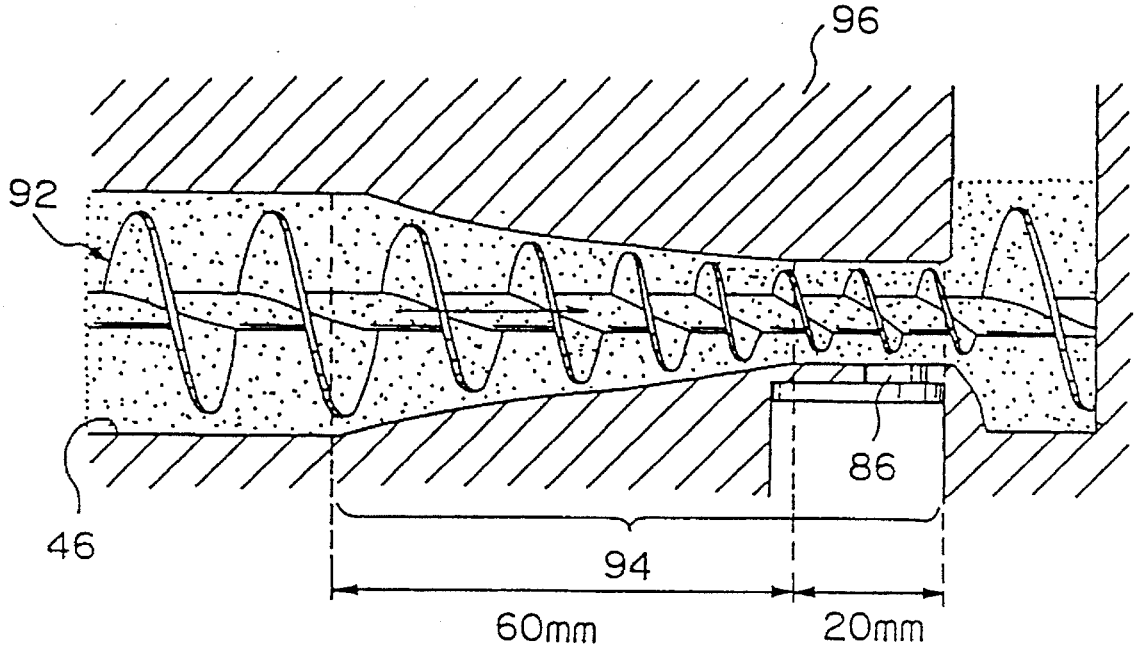
FIG. 23 is a cross-sectional view showing a developing device having a screw member which is suitable for an accurate measurement of a magnetic permeability of a developer.

In an embodiment shown in FIG. 23, a screw member 92 is used in place of the screw member 54*b*, and is suitable for an accurate measurement of a magnetic permeability for detecting a content of the toner component in the developer. In this embodiment, the screw member 92 has a left-hand screw flight and is rotated to propel the developer in a direction indicated by an arrow in FIG. 23. The screw flight of the screw member 92 has a section 94 as a part thereof, a diameter of which is gradually reduced along the propellant direction of the developer. For example, when the screw member 92 has an outer flight diameter of 24 mm, a diameter of the reduced section 94 is gradually varied from 24 mm to 15 mm over a length of 60 mm, and is then kept constant over a length of 20 mm, as shown in FIG. 23. A barrage block member 96 is disposed above the screw member 92 in substantially the same manner as the barrage block member 88' shown in FIGS. 21(*a*) and 21(*b*), and has a concave surface formed on a lower side thereof to complementarily receive a part of the screw member 92. Namely, the concave surface is formed of a tapered surface section for receiving the reduced section 94 of the screw member 92 and a semi-cylindrical surface section for receiving another section of the screw member 92. On the other hand, the vessel 46 has a partially raised portion on which a tapered concave surface section is formed to complementarily receive the reduced section 94 of the screw member 92. Thus, the tapered surface sections of the barrage member 96 and the vessel bottom define a tapered passage through which the developer is propelled by the reduced section 94 of the screw member 92. The permeameter 86 is incorporated into the raised portion of the vessel bottom in the vicinity of the smallest opening end of the tapered passage. With this arrangement, a magnetic permeability can be measured by the permeameter 86 on a small mass of the developer, and thus it is possible to eliminate uncertain factors which may disadvantageously affect the measurement of magnetic permeability.

Figure 24:
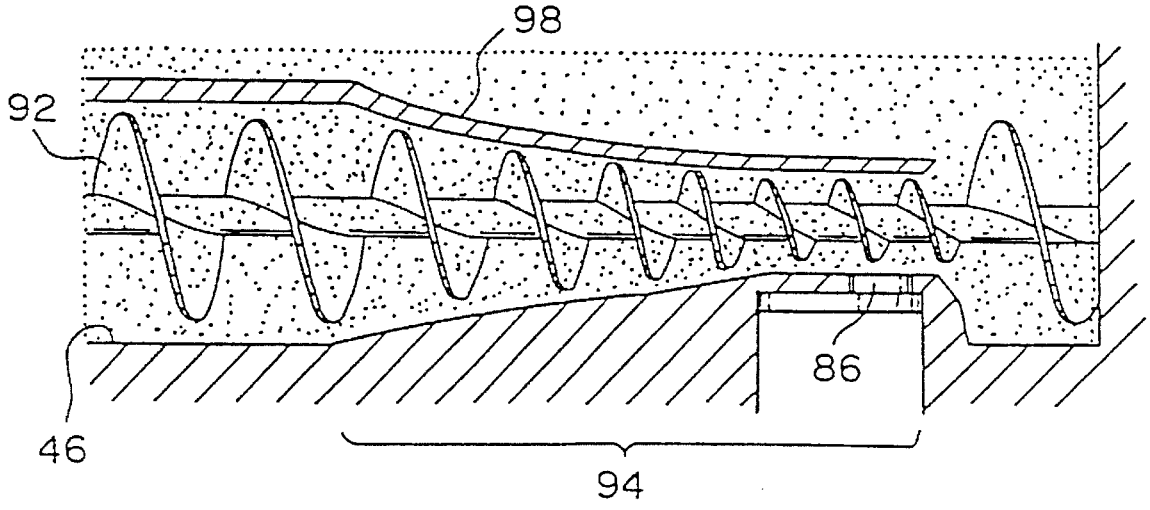
FIG. 24 is a cross-sectional view showing a modification of the developing device shown in FIG. 23.

FIG. 24 shows a modification of the embodiment as shown in FIG. 23. In this modified embodiment, a semi-cylindrical plate member 98 is used in place of the barrage block member 96, and has a tapered section for complementarily receiving the reduced section 94 of the screw member 92. As apparent from FIG. 24, the semi-cylindrical plate member 98 is provided in the vessel 46 to be immersed in the developer held therein, so that the circulation of the developer can be smoothly carried out without any stagnation of the developer.

Figure 25:
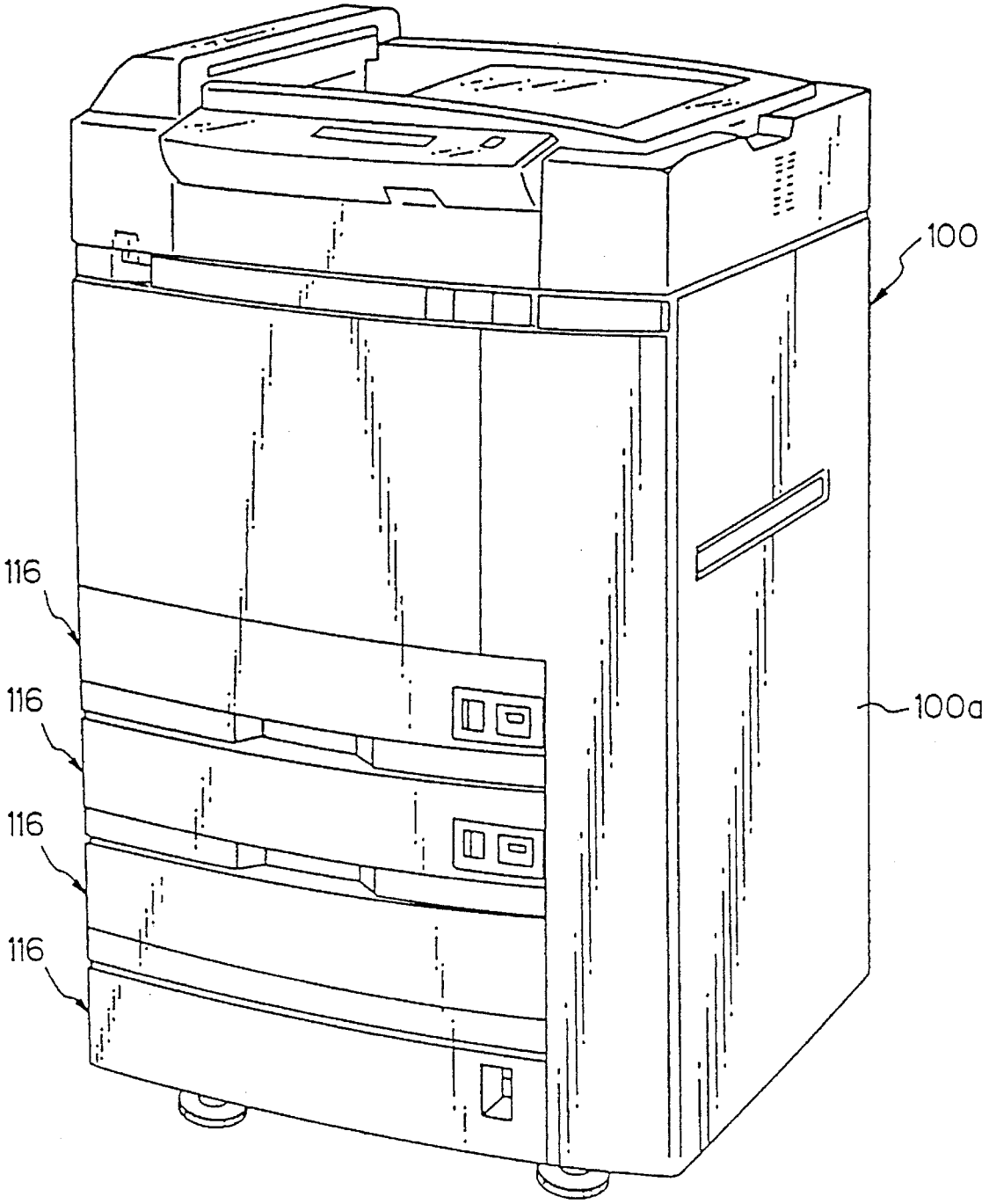
FIG. 25 is a perspective view showing an office use type printer using a developing device with a developer supplier according to the present invention.
Figure 26:
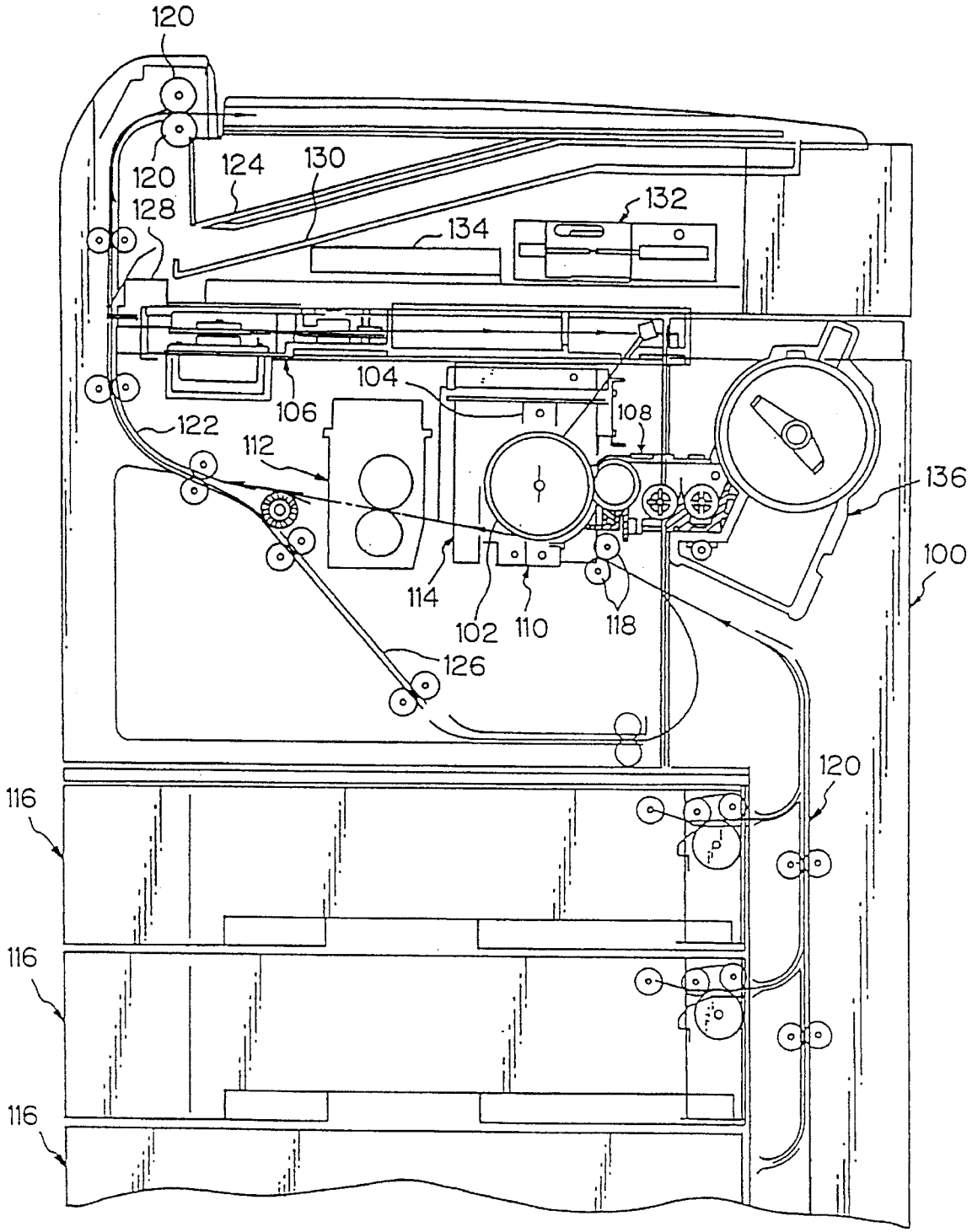
FIG. 26 is a schematic view showing an interior arrangement of the printer shown in FIG. 25.

FIGS. 25 and 26 show an office use type printer comprising a printer housing 100, a rotary photosensitive drum 102, an electric discharger 104, a laser beam scanner 106, a developing device 108, and a transfer charger assembly 110, a toner image fixing device 112, and a toner cleaner 114, and each of these elements corresponds to those of the printer as shown in FIG. 1. Note, the developing device 108 is constructed according to the present invention, and has at least one feature of the present invention as mentioned above.

This office type printer is provided with a plurality of paper cassettes 116, each of which receives a stack of cut sheet paper having a given paper size. A sheet of paper fed from one of the paper cassettes 116, is once moved to a pair of register rollers 118, 118 through a paper guide 120, and is then introduced, at a given timing, into a clearance between the drum 102 and the transfer charger assembly 110, in which a toner image transferring process is carried out, as mentioned hereinbefore. Successively, the paper carrying the transferred toner image is moved to the fixing device 112, in which the transferred toner image is fixed on the paper, and then the paper having the fixed toner image is fed to a pair of paper discharging rollers 120, 120 along a paper guide 122, and is thus discharged from the paper discharging rollers 120, 120 to a paper receiver 124 provided at the top of the printer housing 100.

The printer is constituted such that printing can be made on both side faces of a sheet of paper. To this end, the paper guide 122 includes a paper bypass guide 126 extended from a location adjacent to a paper-discharge side of the fixing device 112 to a location adjacent to a paper-entrance side of the register rollers 118, 118, and is provided with a paper switch 128 incorporated therein. On the other hand, the printer housing is provided with a provisional paper receiver 130 provided below the paper receiver 124. When double-sided printing is performed, a paper discharged from the fixing device 112, i.e., a paper having printing on one side face thereof is once introduced into the provisional paper receiver 130 by actuating the paper switch 128, and is then returned to the register rollers 118, 118 through the paper bypass guide 126 for printing on the other side face thereof. Thereafter, the paper having the printing on both side faces thereof is discharged from the paper discharging rollers 120, 120 to the paper receiver 124 through the paper guide 122.

Note, in FIG. 26, reference 132 indicates a floppy disk driver for reading out code data from a floppy disk loaded therein, and reference 134 indicates a controller for controlling an operation of the printer. The code data read out from a floppy disk is converted into image data, on the basis of which printing is carried out.

Figure 27:
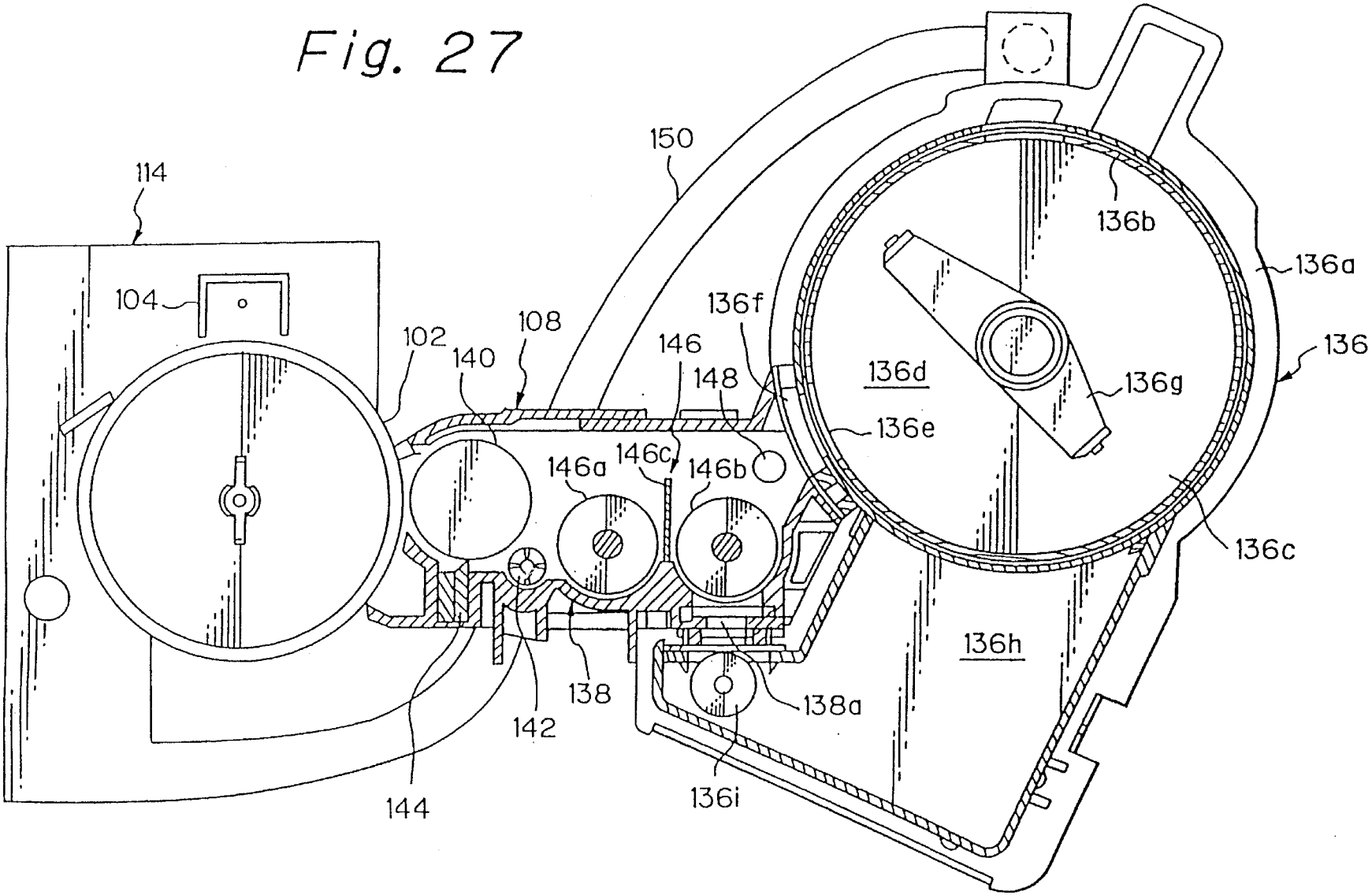
FIG. 27 is an enlarged cross-sectional view showing the developing device with the developer supplier used in the printer shown in FIGS. 25 and 26.

In the office type printer as mentioned above, since a large amount of developer is consumed, the developing device 108 according to the present invention is provided with a cartridge type developer supplier 136, as best shown in FIG. 27. Note, the developing device 108 includes a vessel 138 for holding the two-component developer, a developing roller or magnetic roller 140 for carrying the developer to the drum 102, a paddle roller 142 feeding a fresh part of the developer to the magnetic roller 140, a doctor blade 144 for regulating an amount of the developer brought by the magnetic roller 140, and a screw type agitator 146 having two screw members 146*a* and 146*b* and a partition member 146*c* provided therebetween, and each of these elements corresponds to those of the developing device 18 as shown in FIGS. 2 and 3.

The cartridge type developer supplier 136 includes an outer cylindrical housing 136*a*, and an inner cylindrical container 136*b* rotatably housed within the outer container 136*a*. An interior of the container 136*b* is divided into two chambers by a partition 136*c*: one chamber is indicated by reference 136*d* in FIG. 27, but the other chamber is not visible in this drawing. The container has two outlet ports formed therein: one outlet port 136*e* is located on a wall section of the container 136*b* by which the chamber 136 is defined, and the other outlet port is located on another wall section of the container 136*b* by which the not visible chamber is defined. Also, the housing 136*a* has two outlet ports formed therein: one outlet port is indicated by reference 136*f*, but the other outlet port is not visible. As apparent from FIG. 27, the outlet ports 136*e* and 136*f* can be registered with each other by rotating the container 13*b* in the housing 136*a*, and this is also true for the not visible outlet ports of the housing 136*a* and the container 136*b*. Note, the rotation of the container can be carried out by manually operating a pair of levers (not shown) provided at the outer end walls of the housing 136*a*, and the registration of the outlet ports with each other can not be performed until the developer supplier 136 is attached to the developing device 108. The developer supplier 36 also includes a rotatable paddle member 136*g* provided in the chamber 136*d*, and another rotatable paddle member provided in the not visible chamber. The housing has an extended portion integrally formed therewith, which defines an empty chamber 136*h*.

When the developer supplier 136 is new, the chamber 136*d* holds a two-component developer composed of a toner component and a magnetic component, and the not visible chamber holds only a toner-component or supplemental toner. When a developer held in the vessel 138 is deteriorated, a new developer supplier is exchanged by the old developer supplier. In particular, first, a movable door 100*a* of the printer housing 100 is opened to access the old developer supplier. After the old developer supplier is detached from the developing device 108, the new developer supplier is attached to the developing device 108. At this time, an outlet port 138*a* formed in a bottom of the vessel 138 is opened so that the vessel 138 is in communication with the empty chamber 136*h*. The deteriorated developer is discharged from the vessel 138 into the empty chamber 136*h* through outlet port 138*a* by driving the agitator 146, and this discharge of the developer is facilitated by a paddle roller 136*i* provided in the empty chamber 136*h*.

After the discharge of the developer is completed, the outlet port 138*a* is closed, and the container 136*b* is rotated in the housing 136*a* for the registration of the outlet ports thereof. Then, the paddle member 136*g* is rotated to introduce the new developer from the chamber 136*d* into the vessel 138 of the developing device 108, and after the introduction of the new developer is complete, the developing device is ready. During an operation of the printer, the paddle member provided in the not visible chamber of the container 136*b* is rotated, if necessary, to supplement a part of the toner from the not visible chamber to the vessel 138 through a feeder pipe (not shown), one end of which is opened at a side wall of the vessel 138 as indicated by reference 148 in FIG. 27. This supplement of the toner can be reasonably controlled by the magnetic permeability measuring arrangement, as shown in FIGS. 20(*a*) and 20(*b*), FIGS. 21(*a*) and 21(*b*), FIGS. 22(*a*) and 22(*b*), and FIGS. 23 and 24. Note, the toner cleaner 144 is provided with a flexible toner feeder pipe 150, a free end of which is detachably connected to the developer supplier 136 so that a toner removed from the drum 102 by the toner cleaner 114 is fed to the chamber 136 of the developer supplier 136.

Finally, it will be understood by those skilled in the art that the foregoing description is of preferred embodiments of the present invention, and that various changes and modifications can be made without departing from the spirit and scope thereof.

We claim:

1. A developing device using a two-component developer composed of a toner component and a magnetic component, said developing device comprising:

vessel means for holding the developer;

magnetic roller means rotatably provided within said vessel means to bring the developer to a developing zone for a development of an electrostatic latent image; and agitator means provided within said vessel means for agitating and circulating the developer to cause a triboelectrification between the toner component and the magnetic component and a uniform distribution of the toner component in the magnetic component, wherein said agitator means includes a first screw means disposed in parallel with said magnetic roller means and rotated in such a manner that a developer entangled by said first screw means is upwardly moved from a bottom side of said vessel means toward a top side thereof at a side of said first screw means adjacent to said magnetic roller means, to thereby present a uniform density mass of the developer to said magnetic roller means, wherein the first screw means includes a continuous screw flight spirally extending along an axis of said first screw means, and wherein the first screw means is rotated in a direction so that the developer is upwardly moved at a side of said first screw means adjacent to the magnetic roller means while the developer is entangled and propelled by said continuous screw flight of the first screw means in a directional along said axis.

2. A developing device as set forth in claim 1, wherein said magnetic roller means is rotated in the same direction as said first screw means so that a developer brought by said magnetic roller means, passed through said developing zone, and removed from said magnetic roller means is entrapped by said first screw means.

3. A developing device as set forth in claim 1, further comprising blade means engaged with said magnetic roller means for removing a developer brought by said magnetic roller means and passed through said developing zone, from said magnetic roller means, said blade means being at least extended to a location adjacent to a side of said agitator means next to said magnetic roller means.

4. A developing device as set forth in claim 1, wherein said first screw means includes a single screw flight.

5. A developing device as set forth in claim 1, wherein said first screw means includes a plurality of propeller elements.

6. A developing device using a two-component developer composed of a toner component and a magnetic component, said developing device comprising:

vessel means for holding the developer;

magnetic roller means rotatably provided within said vessel means to bring the developer to a developing zone for a development of an electrostatic latent image; and agitator means provided within said vessel means for agitating and circulating the developer to cause a triboelectrification between the toner component and the magnetic component and a uniform distribution of the toner component in the magnetic component, wherein said agitator means includes a first screw means disposed in parallel with said magnetic roller means and rotated in such a manner that a developer entangled by said first screw means is upwardly moved from a bottom side of said vessel means toward a top side thereof at a side of said first screw means adjacent to said magnetic roller means, to thereby present a uniform density mass of the developer to said magnetic roller means, and wherein said agitator means further includes second screw means disposed in parallel with said first screw means at an opposite side thereof apart from said magnetic roller means, and said first and second screw means are arranged to define a developer circulating passage, and are cooperatively rotated in such a manner that a propellant force derived from said first and second screw means is prevented from being directed to a corner involved in said developer circulating passage.

7. A developing device as set forth in claim 6, wherein each of said first and second screw means includes a single screw flight.

8. A developing device as set forth in claim 6, wherein each of said first and second screw means includes a plurality of propeller elements.

9. A developing device using a two-component developer composed of a toner component and a magnetic component, said developing device comprising:

vessel means for holding the developer;

magnetic roller means rotatably provided within said vessel means to bring the developer to a developing zone for a development of an electrostatic latent image;

agitator means provided in said vessel means for agitating and circulating the developer to cause a triboelectrification between the toner component and the magnetic component and a uniform distribution of the toner component in the magnetic component, said agitator means including presentation means for presenting a uniform density mass of the developer to said magnetic roller means; and blade means engaged with said magnetic roller means for removing a developer brought by said magnetic roller means and passed through said developing zone, from said magnetic roller means, said blade means being at least extended to a location adjacent to a side of said agitator means next to said magnetic roller means, wherein said blade means has an acute edge formed thereat, and is arranged such that the acute edge thereof is close to said magnetic roller means at a transition at which a radial magnetic flux density is substantially zero.

10. A developing device as set forth in claim 9, wherein a gap width between said magnetic roller means and the acute edge of said blade means is at most 0.5 mm.

11. A developing device using a two-component developer composed of a toner component and a magnetic component, said developing device comprising:

vessel means for holding the developer;

magnetic roller means rotatably provided within said vessel means to bring the developer to a developing zone for a development of an electrostatic latent image;

agitator means provided in said vessel means for agitating and circulating the developer to cause a triboelectrification between the toner component and the magnetic component and a uniform distribution of the toner component in the magnetic component, said agitator means including presentation means for presenting a uniform density mass of the developer to said magnetic roller means; and blade means engaged with said magnetic roller means for removing a developer brought by said magnetic roller means and passed through said developing zone, from said magnetic roller means, said blade means being at least extended to a location adjacent to a side of said agitator means next to said magnetic roller means, wherein said blade means has a film edge element attached thereto, and is arranged such that said film edge element is in contact with said magnetic roller means at a transition at which a radial magnetic flux density is substantially zero.

12. A developing device as set forth in claim 11, wherein a thickness of said film edge element is at most 0.5 mm.

13. A developing device using a two-component developer composed of a toner component and a magnetic component, said developing device comprising:

vessel means for holding the developer;

magnetic roller means rotatably provided within said vessel means to bring the developer to a developing zone for a development of an electrostatic latent image; and agitator means provided within said vessel means for agitating and circulating the developer to cause a triboelectrification between the toner component and the magnetic component and a uniform distribution of the toner component in the magnetic component, wherein said agitator means includes a first screw means disposed in parallel with said magnetic roller means and rotated in such a manner that a developer entangled by said first screw means is upwardly moved from a bottom side of said vessel means toward a top side thereof at a side of said first screw means adjacent to said magnetic roller means, to thereby present a uniform density mass of the developer to said magnetic roller means, and wherein said agitator means further includes a second screw means disposed in parallel with said first screw means at an opposite side thereof apart from said magnetic roller means, said first and second screw means being arranged to define a developer circulating passage, and a developer mass regulating means is provided in said developer circulating passage to uniformly regulate a mass of the developer at a given location of said developer circulating passage for a proper measurement of magnetic permeability of said mass.

14. A developing device using a two-component developer composed of a toner component and a magnetic component, said developing device comprises:

vessel means for holding the developer;

magnetic roller means rotatably provided within said vessel means to bring the developer to a developing zone for a development of an electrostatic latent image; and agitator means provided within said vessel means for agitating and circulating the developer to cause a triboelectrification between the toner component and the magnetic component and a uniform distribution of the toner component in the magnetic component;

wherein said agitator means includes endless belt means for presenting a uniform density mass of the developer to said magnetic roller means, and said endless belt means is disposed in parallel with said magnetic roller means so as to define a developer circulating passage.

15. A developing device as set forth in claim 14, further comprising blade means engaged with said magnetic roller means for removing a developer brought by said magnetic roller means and passed through said developing zone, from said magnetic roller means.

16. A developing device as set forth in claim 15, wherein said blade means has an acute edge formed thereat, and is arranged such that the acute edge thereof is close to said magnetic roller means at a transition at which a radial magnetic flux density is substantially zero.

17. A developing device as set forth in claim 16, wherein a gap width between said magnetic roller means and the acute edge of said blade means is at most 0.5 mm.

18. A developing device as set forth in claim 15, wherein said blade means has a film edge element attached thereto, and is arranged such that said film edge element is in contact with said magnetic roller means at a transition at which a radial magnetic flux density is substantially zero.

19. A developing device as set forth in claim 18, wherein a thickness of said film edge element is at most 0.5 mm.

20. A developing device using a two-component developer composed of a toner component and a magnetic component, said developing device comprising:

a vessel for holding the developer;

a magnetic roller rotatably provided within said vessel to bring the developer to a developing zone for a development of an electrostatic latent image, said magnetic roller having axis; and an agitator provided within said vessel for agitating the developer, said agitator including a first screw and a second screw arranged in parallel with the axis of said magnetic roller, said first screw being located adjacent to said magnetic roller, said second screw being located farther from said magnetic roller than said first screw, the first screw being rotated to upwardly move the developer between said magnetic roller and said first screw, wherein the first screw includes a continuous screw flight spirally extending along an axis of said first screw, and wherein the first screw is rotated in a direction so that the developer is upwardly moved at a side of said first screw adjacent to the magnetic roller while the developer is entangled and propelled by said continuous screw flight of the first screw in a direction along said axis.

21. A developing device as set forth in claim 20, wherein said magnetic roller is rotated in the same direction as said first screw so that a developer brought by said magnetic roller, passed through said developing zone, and removed from said magnetic roller is entrapped by said first screw.

22. A developing device as set forth in claim 20, wherein said first and second screws are arranged and rotated to define a developer circulating passage along which the developer is circulated in a given direction, and the rotation of said first and second screws is performed in such a manner that a propellant force derived from said first and second screws is prevented from being directed to a corner involved in said developer circulating passage.

23. A developing device as set forth in claim 20, further comprising a blade engaged with said magnetic roller for removing a developer brought by said magnetic roller and passed through said developing zone, from said magnetic roller, said blade being at least extended to a location adjacent to a side of said agitator next to said magnetic roller.

24. A developing device as set forth in claim 23, wherein said blade has an acute edge formed thereat, and is arranged such that the acute edge thereof is close to said magnetic roller at a transition at which a radial magnetic flux density is substantially zero.

25. A developing device as set forth in claim 24, wherein a gap width between said magnetic roller and the acute edge of said blade is at most 0.5 mm.

26. A developing device as set forth in claim 23, wherein said blade has a film edge element attached thereto, and is arranged such that said film edge element is in contact with said magnetic roller at a transition at which a radial magnetic flux density is substantially zero.

27. A developing device as set forth in claim 26, wherein a thickness of said film edge element is at most 0.5 mm.

28. A developing device as set forth in claim 20, wherein said first and second screws are arranged to define a developer circulating passage along which the developer is circulated in a given direction, and a developer mass regulating means is provided in said developer circulating passage to uniformly regulate a mass of the developer at a given location of said developer circulating passage for a proper measurement of magnetic permeability of said mass.

29. A developing device as set forth in claim 20, wherein each of said first and second screws includes a single screw flight.

30. A developing device as set forth in claim 20, wherein each of said first and second screws includes a plurality of propeller elements.

* * * * *

UNITED STATES PATENT AND TRADEMARK OFFICE

CERTIFICATE OF CORRECTION

PATENT NO. : 5,572,299

DATED : November 5, 1996

INVENTOR(S) : Makoto KATO, et al.

It is certified that error appears in the above-indentified patent and that said Letters Patent is hereby corrected as shown below:

Col. 7, line 23, change "0uter" to --outer--.

Col. 9, lines 3 and 42, change "nonuniform" to --non-uniform--.

Col. 12, line 58, change "8" to --θ--.

Signed and Sealed this

Twenty-fifth Day of March, 1997

*Attest:*

Bruce Lehman

BRUCE LEHMAN

*Attesting Officer*

*Commissioner of Patents and Trademarks*